United States Patent [19]

Haneda et al.

[11] Patent Number: 5,061,966

[45] Date of Patent: Oct. 29, 1991

[54] METHOD OF CLEANING AN IMAGE RETAINER

[75] Inventors: Satoshi Haneda; Hisashi Shoji; Seiichiro Hiratsuka; Tadao Kishimoto; Toshifumi Isobe; Hiroyuki Maruyama; Jun Yokobori, all of Hachioji, Japan

[73] Assignee: Konica Corporation, Tokyo, Japan

[21] Appl. No.: 526,543

[22] Filed: May 18, 1990

Related U.S. Application Data

[60] Continuation of Ser. No. 82,935, Aug. 5, 1987, abandoned, which is a division of Ser. No. 823,407, Jan. 28, 1986, abandoned.

[30] Foreign Application Priority Data

Jan. 31, 1985 [JP] Japan ..... 60-18371
Dec. 24, 1985 [JP] Japan ..... 60-296340

[51] Int. Cl.[5] ..... G03G 21/00

[52] U.S. Cl. ..... 355/297; 355/296; 430/125

[58] Field of Search ..... 355/296, 297, 299, 301; 430/125

[56] References Cited

U.S. PATENT DOCUMENTS

| | | | |
|---|---|---|---|
| 3,819,263 | 6/1974 | Draugelis et al. | 355/215 |
| 3,879,123 | 4/1975 | Fisher | 355/301 |
| 3,918,808 | 11/1975 | Narita | 355/297 |
| 3,940,282 | 2/1976 | Hwa | 355/299 X |
| 4,275,134 | 6/1981 | Knechtel | 355/327 X |
| 4,364,660 | 12/1982 | Oda | 355/297 |
| 4,396,276 | 8/1983 | Murasaki | 355/299 |
| 4,445,772 | 5/1984 | Aoki et al. | 355/326 X |
| 4,449,241 | 5/1984 | Nakayama | 355/299 X |
| 4,568,174 | 2/1986 | Stange | 355/300 |
| 4,572,651 | 2/1986 | Komatsu et al. | 355/326 X |

FOREIGN PATENT DOCUMENTS 0037248 10/1981 European Pat. Off. .

*Primary Examiner*—Fred L. Braun
*Attorney, Agent, or Firm*—Jordan B. Bierman

[57] ABSTRACT

A method of cleaning an image retainer by removing remaining toner particles from the retainer after transferring a multi-color toner image which is obtained by a multi-color toner image forming process wherein charging, image writing-in, and developing steps are repeated at least twice, abutting a cleaning member against the retainer after a final image writing-in step of the image forming process has been completed, and releasing the cleaning member from abutment after the cleaning has been completed but not during the image writing-in step for forming a next multi-color toner image.

13 Claims, 11 Drawing Sheets

FIG. 20ℓ

METHOD OF CLEANING AN IMAGE RETAINER

This application is a continuation of application Ser. No. 082,935, filed Aug. 5, 1987, now abandoned, which in turn is a division of application Ser. No. 823,407, filed Jan. 28, 1986, now abandoned.

BACKGROUND OF THE INVENTION

1. Field of the Invention

The present invention relates to an image forming apparatus.

2. Description of the Prior Art

In the prior art, in order to form a multi-color image by the electrophotography, for example, a series of copying steps of charge, exposure, development and transfer are repeated for each color component to transfer toner images in individual colors onto a copy paper in a superposed manner. For example, electrostatic latent images are formed separately at the respective steps by separated colors such as blue, green and red separated through a color separation filter and are developed in Yellow, Magenta and Cyan and, if necessary, black toner to form toner images. These toner images are laminated on and transferred to a recording paper to form the multi-color image. In this multi-color forming method, however, there arise difficulties: (1) a transfer to a transfer member becomes necessary at the end of development of each color to enlarge the size of machinery and to elongate the time period for the image formation; and (2) warranty for precision against failure of registration due to the repeated operations becomes necessary.

Therefore, there has been proposed a multi-color image forming method for eliminating those difficulties by developing a plurality of toner images on a common photosensitive member in a superposed manner to reduce the transfer steps to one. However, this method is also encountered by a trouble that a toner image obtained at a previous developing step is disturbed at a subsequent developing step or that toner in a developer at a preceding step is mixed with a developer at a succeeding step to disturb the color balance of the multi-color image.

In order to avoid this trouble, there has also been developed a method for forming a multi-color image by adopting a method in which a bias having a superposed a.c. component is applied to a developing device at second or later developments to fly toner onto an electrostatic latent image formed on a photosensitive member. According to this method, the developer layer will not rub the toner image or images formed at the preceding step so that no image disturbance will occur.

The principle of this image forming method will be described in the following with reference to the flow chart of FIG. 4. FIG. 4 shows changes in the surface potential of the photosensitive member and takes up a case in which the charge polarity is positive. Reference letters PH indicate an exposed portion of the photosensitive member; letters DA an unexposed portion of the photosensitive member; and letters DUP the rise of potential, which is caused as a result that positively charged toner T sticks to the exposed portion PH at a first development.

The photosensitive member turning at a constant speed is charged evenly by a scorotron charger to have a constant positive surface potential E, as shown in (a). Next, a first image exposure is effected by means of an exposing source such as a laser, a cathode ray tube or an LED so that the potential of the exposed portion PH drops, as shown in (b), in accordance with the quantity of light. An electrostatic latent image thus formed is developed by means of a developing device to which is applied a positive bias substantially equal to the surface potential E of the unexposed portion. As a result, as shown in (c), the positively charged toner T sticks to the exposure portion having a lower potential to form the first toner image T. The region formed with that toner image has the potential rise DUP as a result of the stick of the positively charged toner T, but will not have the same potential as that of the unexposed portion DA. Next, the photosensitive member surface formed with the first toner image is subjected to a second charge by a charger so that it takes the uniform surface potential E despite whether the toner T is present or absent. This is shown in (d). The surface of that photosensitive member is subjected to a second image exposure to form an electrostatic latent image (as shown in (e)), and a positively charged toner image T′ in a color different from that of the toner T is developed like the step (c) to form a second toner image. This is shown in (f). The process thus far described is repeated to form a multi-color toner image on the photosensitive member. The multi-color toner image is transferred onto a sheet of recording paper, and it is further heated and pressed for fixing to obtain a multi-color recorded image. In this case, the photosensitive member is cleaned through cleaning of the toner and charges having remained on its surface and is used for forming a next multi-color image. On the other hand, there is another method by which a toner image is fixed on a photosensitive member in a different manner.

In the method described with reference to FIG. 4, it is desirable that at least the developing step of (f) be conducted such that the developer layer is out of contact with the photosensitive member surface.

Incidentally, in the aforementioned multi-color image forming method, in case that charging is repeated each time of the image formation, a charge eliminating step by a light exposure or a corona discharging may be incorporated before the charging step. On the other hand, the exposure source for the image exposure may be identical or different at each time.

In the aforementioned multi-color image forming method, the four color toners, e.g., Yellow, Magenta, Cyan and black are frequently superposed on the photosensitive member for the following reason. According to the color subtractive principle, a black image must be formed by superposing the three primaries, i.e., Yellow, Magenta and Cyan. However, since the practical toners for the three primaries do not have ideal absorptive wavelength ranges and since the toner images in the three primaries will come out of registration, those three primary toners will find it difficult to reproduce the clear black color required for letters or lines, and in addition the color image is liable to come short of density. As has been described above, therefore, the multi-color image is formed in the four colors composed of the black in addition to the three primaries.

As the latent image forming method for forming the multi-color image, there can be used in addition to the aforementioned electrophotographic method a method, in which charges are implanted directly into an image forming member by means of a multi-styrus electrode to form an electrostatic latent image, or a method in which a magnetic latent image is formed by means of a magnetic head.

In case various colors are to be reproduced by the aforementioned methods, there are the following two systems:

(1) a system in which toners in different colors are not superposed directly; and (2) a system in which the different-color toners are superposed.

According to the former system (1), as shown in FIG. 14(A), a color reproduction is falsely effected on the recording paper by distributing toners $T_1$ and $T_2$ in a non-superposed manner on an image retainer. According to the latter system (2), the color reproduction is effected by developing on a toner image in a certain color a toner in different color in a superposed manner.

Incidentally, in the case of the electrophotographic method, for example, according to the system (2), the light is absorbed by the previously developed toner T to fail to reach the photosensitive layer of the image retainer sufficiently so that the latent image is not formed completely. This invites a tendency that the sticking amount of the later developed toner $T_2$ becomes less, as shown in FIG. 15 or FIG. 16. According to the system (1), on the other hand, it is necessary to register the image exposures so strictly that the toner images in the individual colors are not registered in identical positions with one another. If the positioning of the image exposure is imprecise, as shown in FIG. 14(B), the tendency is that the toner image $T_1$ at the preceding step will shield a portion of the image exposure so that the sticking amount of the toner image $T_2$ to be developed at the succeeding step will become short, as shown in FIG. 14(C). These tendencies indicate that the recording characteristics will become different in dependence upon the spectroscopic sensitivity of the image retainer, the spectroscopic characteristics of the light source for the image exposure, the spectroscopic transmissivity characteristics of the toners, and the order of the colors to be developed.

Incidentally, in the state that the image is formed on the recording paper in the aforementioned manner, the toners having failed to be transferred to the recording paper are left on the image retainer (or the photosensitive member), and this photosensitive member has to be cleaned because those residual toners obstruct the formation of a next image. This cleaning is effected, as will be described hereinafter, by the method in which a blade and/or a fur brush is brought into abutment against the photosensitive member to scrape off the residual toners left on the photosensitive member.

This cleaning exerts a serious influence upon the turning velocity of the photosensitive member. If the blade or the fur brush is brought into abutment against the photosensitive member, more specifically, it acts as it were a brake to fluctuate the turning velocity of the photosensitive member although slightly. If the blade or the fur brush in that abutting state is brought away from the photosensitive member, on the other hand, the turning velocity of the photosensitive member is also fluctuated.

Especially if the r.p.m. of the photosensitive member changes even slightly when the latent images are to be formed, the images obtained have their individual colors misregistered.

In the cleaning device to be used in the color image forming apparatus, moreover, the operations of bringing the blade member into and out of abutment are conducted for the turning period of the image retainer so that the turning velocity of the image retainer is fluctuated to some extent by the frictional resistance resulting from that abutment. As a result, if the blade member is brought into or out of the abutment especially while a latent image is being formed on the image retaining surface by an exposure, the circumferential speed of the image retaining surface may be changed to cause disturbances due to the discontinuity of the image scanning thereby to deteriorate the image quality.

SUMMARY OF THE INVENTION

The present invention has been conceived in view of the background described above and has an object to provide an image forming apparatus which is freed from any fear of the aforementioned misregistration in the recorded image obtained and which can be expected to have an efficient image formation.

Another object of the present invention is to provide a color image forming apparatus which prevents the turning velocity of an image retainer from being fluctuated while a latent image is being formed by an exposure so that a color image of excellent quality can be copied without any disturbance of the original image.

According to the present invention, more specifically, there is provided an image forming apparatus for repeating the steps of writing an image on an image retainer and forming a toner image subsequent to said image writing step, which apparatus is characterized in that the starts of bringing a cleaning member into and out of abutment against said image retainer are conducted at the time other than at least the time of said image writing step.

The order of the respective steps for forming the recorded image, which are influenced by the changes in the turning velocity of the image retainer (or the photosensitive member) is the step of forming the latent image (especially the step of writing the image), the developing step (i.e., the step of forming the toner image), and the charging step. The transferring step is only slightly or not influenced, and the fixing step is not influenced at all.

The latent image formation will be described in the following. The human eye is sensitive to the relative position precision, especially the precision of primary and secondary derivatives. In a laser printer, too, the positional precision has to be one several-th, desirably one tenth or lower of the dot pitch. According to the experiments, the positional precision has to be held within $\pm 13$ μm for a dot pitch of 8 dots/mm, $\pm 8$ μm for 12 dots/mm, and within $\pm 6$ μm for 16 dots/mm. If the turning velocity of the photosensitive member changes during the latent image formation, the failure of registration occurs for each color of the superposed toner images, and this misregistration, even if small, is visually recognized. This makes it necessary to hold the turning velocity of the photosensitive member during the latent image formation highly accurately at a constant value.

The development will be described in the following. The procedure of forming the toner image on the latent image is not in an equilibrium state so that the density of the toner image is inversely proportional to the circumferential velocity of the photosensitive member. As a result, the density of the recorded image obtained will change if the turning velocity of the photosensitive member changes.

The charge will be described in the following. This charge is not effected in the equilibrium state like the aforementioned development, but the dependency of the charge potential upon the charge time period can be substantially eliminated in dependence upon the structure of the charger by using the corona discharger having an a.c. component or the scorotron charger, for example. In case the development is conducted in the reversal manner, moreover, the difference between the potential of the exposed portion and the developing bias potential leads to the latent image contrast so that the influence of the changes in the charge potential upon the latent image is reluctant to occur.

For the transfer, the corona transfer is little dependent upon the velocity, and the recording paper is moved to follow the photosensitive member by the corona discharge so that it follows the changes in the r.p.m. of the photosensitive member. The transfer roller and the adhesive roller may follow the photosensitive member.

The fixing has no relationship to the toner image formation.

For the aforementioned reason, in order to maintain the positional precision of the latent image, the abutment of the cleaning member against the photosensitive member, which will change the turning velocity of the photosensitive member, is neither effected nor released upon at least the latent image formation (especially in the image writing). At the instant when the latent image formation is ended (i.e., when the trailing end of the latent image is positioned in the latent-image formed portion), the cleaning member comes into abutment against the photosensitive member. Especially if the arrangement of the latent image forming means and the cleaning member is made such that the cleaning member is disposed slightly in front of the position to which the leading end of the latent image comes at the end of the formation (i.e., in which the leading end of the toner left on the photosensitive member is positioned after the transfer), the cleaning member can be brought into abutment against the photosensitive member to conduct its cleaning action effectively after the end of the formation of the last latent image and before the residual toner reaches the cleaning member. After the end of the cleaning action, the aforementioned abutment of the cleaning member is released, and the formation of the latent image for a subsequent image forming process is successively started.

In order to prevent an unevenness in the density of the toner image, moreover, it is desirable to bring the cleaning member into abutment against the photosensitive member after the end of the last development. In order to prevent an unevenness of the charge potential, still moreover, it is more desirable to complete the release of the abutment of the cleaning member against the photosensitive member in the preceding image forming process before the start of the charge. In these cases, the disposition of the cleaning member may desirably be determined in accordance with the aforementioned concept.

Other objects and features of the present invention will be made apparent from the following description taken with reference to the accompanying drawings.

BRIEF DESCRIPTION OF THE DRAWINGS

FIGS. 19*a*–19*h* and 20*i*–20*n* are diagrams showing the individual image forming steps according to the present invention.

DESCRIPTION OF THE PREFERRED EMBODIMENTS

Embodiment 1

Figure 1:
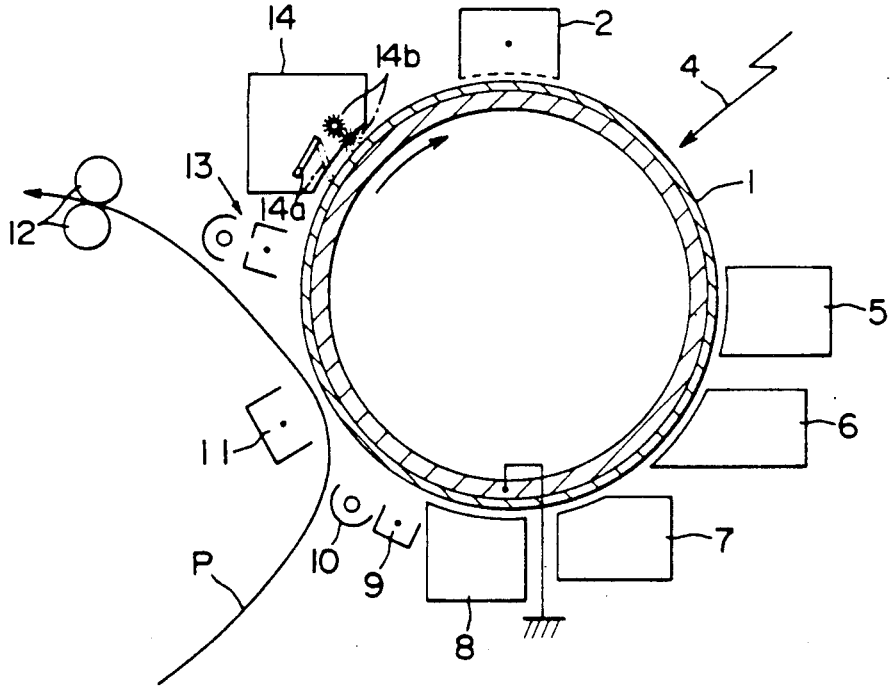
FIGS. 1 and 5 are schematic views showing an essential portion of an image forming apparatus according to the present invention.
Figure 2:
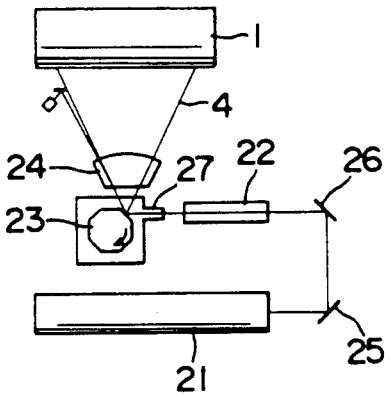
FIG. 2 is a schematic view showing an essential portion of a laser beam scanner.
Figure 3:
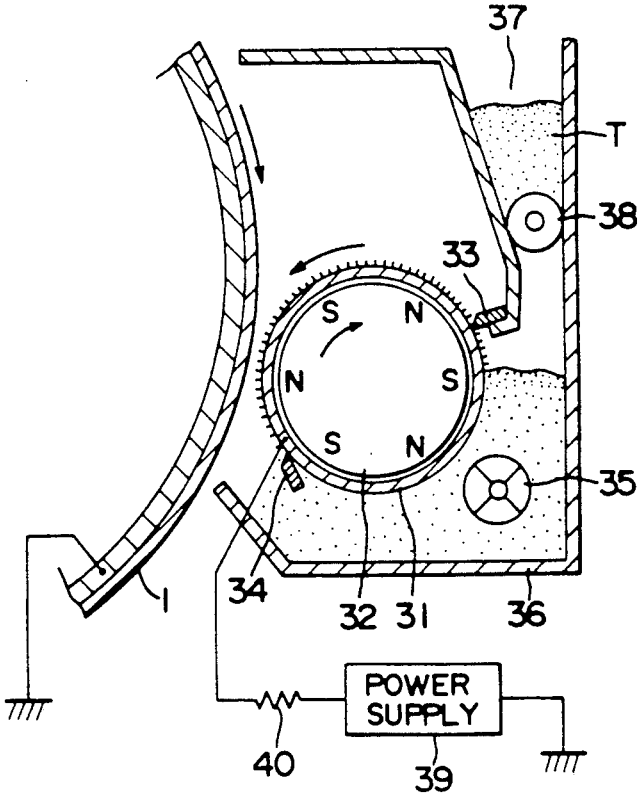
FIG. 3 is a sectional view showing a developing device.
Figure 4:
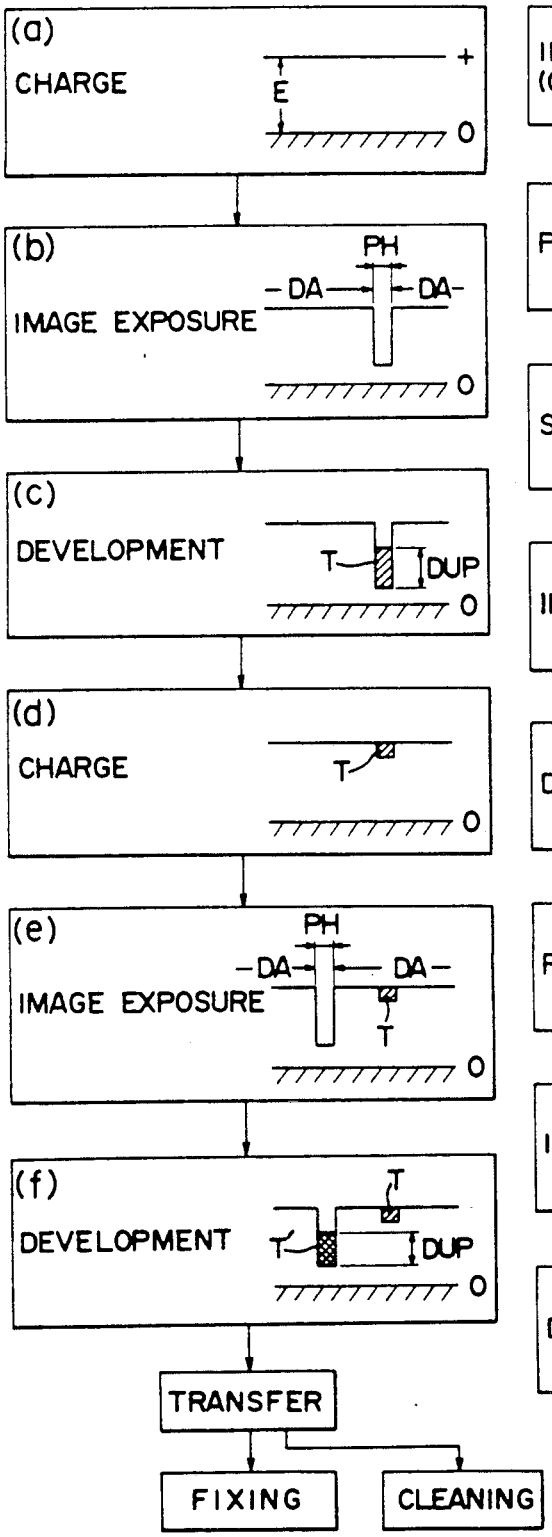
FIGS. 4, 9 and 11 are flow charts showing image forming processes.

FIG. 1 is a schematic view showing the structure of one example of an image forming apparatus based on the present invention; FIG. 2 is a schematic view showing the structure of a laser beam scanner for image exposure; FIG. 3 is a partially sectional view showing one embodiment of a developing device; and FIG. 4 is a flow chart for practising that example.

In the image forming apparatus of FIG. 1: reference numeral 1 indicates a drum-shaped image retainer having a surface layer of a photoconductive and photosensitive material such as Se and made rotatable in the direction of arrow; numeral 2 a charger for charging the surface of the image retainer 1 evenly; numeral 4 an image exposing light in each color for each color image; numerals 5 to 8 developing devices using as developing toners in different colors such as Yellow, Magenta, Cyan and black; numerals 9 and 10 a pretransfer charger and a pretransfer exposing lamp disposed, if necessary, for making it easy to transfer the color images, which are formed on the image retainer 1 with a plurality of superposed color toner images, to a recording member P; numeral 11 a transfer device; numeral 12 is a fixing device for fixing the toner images transferred to the recording member P; numeral 13 is a charge eliminating device composed of a charge eliminating lamp and/or a charge eliminating discharger; and numeral 14 is a cleaning device having a cleaning blade 14*a* and a fur brush 14*b* for coming into contact with the surface of the image retainer 1, which has a color image transferred thereto, to remove the toners left on the surface and for leaving the surface of the image retainer 1 by the time it is reached by the surface having been subjected to the first development.

The cleaning device 14 is so disposed that it is positioned 10 cm in front of the leading end of a latent image at the instant when the trailing end of the latent image is positioned to be exposed to the light 4.

Here, the charger 2 is preferably exemplified by the shown scorotron corona discharger which is less influenced by the preceding charge so that it can effect a stable charge, especially if it is intended to charge that surface of the image retainer 1, which has already been charged. If the drum-shaped image retainer 1 is used, as in this image forming apparatus, moreover, the image exposing light 4 may be prepared by filtering the slit light as of the ordinary monocolor electrographic copying machine separately for colors by means of a filter, but is preferably prepared by the laser beam scanner shown in FIG. 2 so as to record a clear color image.

The laser beam scanner of FIG. 2 operates to turn on and off the laser beam, which is emitted from a laser 21 such as a He-Ne laser, by means of an acoustic-optical modulator 22, to deflect the modulated laser beam by means of a mirror scanner 23 constructed of a rotary polygonal or octahedral mirror, and to form the deflected laser beam through a focusing f-$\theta$ lens 24 into the image exposing light 4 for scanning the surface of the image retainer 1 at a constant rate. Incidentally, reference numerals 25 and 26 indicate mirrors, and numeral 27 indicates a lens for enlarging the diameter of the beam incident upon the focusing f-$\theta$ lens 24 so as to reduce the diameter of the beam on the image retainer 1. If the laser beam scanner shown in FIG. 2 is used for forming the image exposing light 4, electrostatic images in different colors can be easily formed with a shift, as will be described hereinafter, so that a clear color image can be recorded. Despite of this fact, however, the image exposing light 4 should be limited to neither the aforementioned slitted light nor the dotted light resulting from the laser beam but may be prepared by means of an LED, a CRT, a liquid crystal or an optical fiber transmission element. In the recording apparatus in which the image retainer can take a flat state such as a belt shape, moreover, the image exposing light may be a flash light.

On the other hand, the developing devices 5 to 8 to be used may preferably have the structure shown in FIG. 3.

In FIG. 3: reference numeral 31 indicates a developing sleeve made of a non-magnetic material such as aluminum or stainless steel; numeral 32 a magnet mounted in the developing sleeve 31 and having a plurality of magnetic poles in the circumferential direction; numeral 33 a layer thickness regulating blade for regulating the thickness of the developer layer to be formed on the developing sleeve 31; numeral 34 a scraper blade for removing the developing layer after the development from the developing sleeve 31; numeral 35 an agitating rotary member for agitating the developer in a developer reservoir 36; numeral 37 a toner hopper; numeral 38 a toner supply roller having its surface recessed for entry of the toner to supply the toner from the toner hopper 37 to the developer reservoir 36; and numeral 39 is a power supply for applying a bias voltage containing an oscillating voltage component, as the case may be, to the developing sleeve 31 through a protecting resistor 40 thereby to generate an electric field for controlling the migrations of the toner between the developing sleeve 31 and the image retainer 1. In FIG. 3, the developing sleeve 31 and the magnet 32 are adapted to turn in the directions of arrows, but either the developing sleeve 31 or the magnet may be made stationary, or the developing sleeve 31 and the magnet 32 may turn in an identical direction. In case the magnet 32 is fixed, in order to made the density of the magnetic flux of the magnetic pole facing the image retainer higher than those of the remaining magnetic poles, it is an ordinary practice to strengthen the magnetization or to dispose two magnetic poles of identical or opposite pole in the vicinity of the portion facing the image retainer 1.

In the developing device thus constructed, the magnetic poles of the magnet 32 are ordinarily magnetized to have a density of magnetic flux of 500 to 1,500 Gausses thereby to attract the developer of the developer reservoir 36 onto the surface of the developing sleeve 31 by the resultant magnetic force. The developer attracted has its thickness regulated by the layer thickness regulating blade 33 to form the developer layer. This developer layer is moved in the direction identical (as shown) or opposed to the turning arrow direction of the image retainer 1 to develop an electrostatic image of the image retainer 1 in the developing area, in which the surface of the developing sleeve 31 faces the surface of the image retainer 1, whereas the remainder is scraped away from the surface of the developing sleeve 31 by the scraper blade 34 and it is returned to the developer reservoir 36. Moreover, at least the second and subsequent developments to be repeated for superposing the color toner images are preferably conducted under the non-contact jumping condition so that the toner having sticked to the image retainer 1 as a result of the preceding development may not be misregistered by the suceeding development or developments. FIG. 3 shows the state in which the development is conducted under that non-contact jumping condition.

Still moreover, the developing devices 5 to 8 may preferably use the so-called "two-component developer" which is such a mixture of a non-magnetic toner and a magnetic carrier that the toner need not contain a black or brown magnetic material so that it can have a clear color and can have its charge control facilitated. Especially, the magnetic carrier may preferably be such an insulating carrier having a resistivity not less than $10^8$ Ωcm or, preferably $10^{13}$ Ωcm as is prepared either by dispersing fine particles of a ferromagnetic or paramagnetic material such as ferrosoferic oxide, $\gamma$-ferric oxide, chromium dioxide, manganese oxide, ferrite or manganese-copper alloy into a resin such as styrene resin, vinyl resin, etyl resin, rosin-modified resin, acrylic resin, polyamide resin, epoxy resin or polyester resin or by coating the particles of those magnetic materials with the above-specified resins. If that resistivity is low, there arise a problem that charges are implanted into the carrier particles to make it liable for the carrier particles to stick to the surface of the image retainer 1 or that the bias voltage is not applied sufficiently, even in case the bias voltage is applied to the developing sleeve 31. Especially the carriers sticking to the image retainer 1 will adversely affect the color tone of the color image.

Incidentally, the resistivity is a value which is obtained by tapping the particles in a container having a sectional area of 0.50 $cm^2$, by applying a load of 1 $kg/cm^2$ to the tapped particles, and by reading out a current value when a voltage to establish an electric field of 1,000 V/cm is applied between an electrode acting as a loading member and a bottom electrode.

On the other hand, the carrier is preferred to have an average particle diameter not smaller 5 μm and not larger 50 μm, because it has tendencies to have its magnetization excessively weakened for an average particle diameter smaller than 5 μm and not to have an image improved but to become liable to be subjected to a breakdown or discharge for an average particle diameter larger than 50 μm so that a high voltage cannot be applied.

The toner is preferably prepared to have an average particle diameter of 1 to 20 μm and an average quantity of charge of 3 to 300 μc/g, especially 10 to 100 μc/g by adding a variety of pigments and a charge controlling agent, if necessary, to a resin. The toner becomes reluctant to leave the carrier, if its average particle diameter becomes smaller than 1 μm, and degrades the resolution of an image if the same exceeds 20 μm. A fluidizing agent such as hydrophobic silica, if necessary, is suitably added as an additive to the toner.

If the developer thus made of a mixture of the insulating carrier and the toner is used, the bias voltage to be applied to the developing sleeve 31 of FIG. 3 can be so easily set without any leakage that the toner sufficiently sticks to the electrostatic image without any fog. Incidentally, in order to make more effective the developing mobility control of the toner by the application of that bias voltage, the toner may be made to contain such a magnetic material within a range not to deteriorate the visibility of the color as is used in the magnetic carrier.

Although the foregoing is the construction of the developing device and the composition of the developer to be preferably used in the apparatus of the present invention, the present invention should not be limited thereto but may use the developing device and the developer, which are disclosed in Japanese Patent Laid-Open Nos. 50 - 30537, 55 - 18656 to 18659, and 56 - 144452. Despite of this fact, it is recommended that the apparatus of the present invention resorts to the non-contact jumping developing condition using the two-component developer.

By the apparatus thus far described, the present invention can be practised for the image formation shown in FIG. 4. Incidentally, FIG. 4 shows the step at which the development of FIG. 2 has been carried out.

FIG. 4 shows the embodiment of the present invention, in which an electrostatic image is formed by the electrostatic image forming method using the exposed portion PH as the electrostatic image and the unexposed portion DA as the background, as has been described hereinbefore, and in which the development is conducted by using the toner which is charged with the same polarity as that of the background. According to the recording apparatus of FIG. 1, the surface of the image retainer 1 in the initial state, which has its charge eliminated by the charge eliminating device 13 and cleaned by the cleaning device 14 to have a zero potential, is subjected uniformly to a first charge during its first turn by the charger 2. The charged surface is subjected to a first image exposure by the image exposing light 4 in each color so that the potential of its electrostatic image portion is dropped substantially to zero. The resultant electrostatic latent image is subjected to a first development by means of such one of the developing devices 5 to 8 as uses a developer containing the color toner corresponding to that image exposing light 4. Since the potential of the electrostatic image having risen by the toner T having sticked thereto is still lower than the background potential, the once developed electrostatic image is subjected again uniformly to a second charge (which may be conducted after the surface potential of the image retainer 1 has been reduced to zero by eliminating the uniformly by means of the charge eliminating device 13 (or by means of only the charge eliminating lamp)) during the second turn of the image retainer 1. The surface thus charged is subjected to a second image exposure with the image exposing light 4 in a color different from the aforementioned one so that the potential of the electrostatic image portion is dropped substantially to zero. The electrostatic layer thus obtained is subjected to a second development with a toner T' by another developing device using a developer containing a color toner corresponding thereto. Likewise, third and fourth electrostatic image formations and developments are repeated. When the fourth development is conducted to form a color image on which the color toner images are superposed, the pretransfer charger 9 and the pretransfer exposing lamp 10 are operated until that color image has passed. Next, the color image is transferred by the transfer device 11 to the recording member P which is fed in synchronism with the turns of the image retainer 1. The color image thus transferred is fixed on the recording member P by the fixing device 12. The surface of the image retainer 1 having the color image transferred thereto has its charges eliminated by the charge eliminating device 13 and is cleaned by the cleaning device 14 until it restores its initial state. Thus, one cycle of the color image recording operation is completed according to the present invention.

This cleaning operation is conducted to control the cleaning device 14 such that the cleaning device 14 is actuated (namely, the cleaning blade **14*a* and the fur brush 14*b* are brought into abutment against the image retainer 1) after the end of the fourth latent image formation and before the leading end of the toner left on the image retainer 1 reaches the cleaning blade 14*a*, and such that the cleaning device 14 is released (namely, the cleaning blade 14*a* and the fur brush 14*b* are brought away from the image retainer 1) at the instant when the trailing end of the aforementioned residual toner passes the fur brush 14*b*. On the other hand, the laser beam scanner of FIG. 2 is so controlled that the first latent image formation in the next image process is started immediately after the release of the aforementioned cleaning device 14**.

Each charge for the electrostatic image formation is carried out by the charger 2, and the image exposure is carried out, for example, either by an identical slit exposing device equipped with filter switching means or by an identical exposing device constructed of the laser beam scanner of FIG. 2. As a result, a different image exposing device is not required for each electrostatic image formation so that the recording apparatus can be made in a small size and at a reasonable cost while simplifying the synchronous control of each electrostatic latent image formation. Incidentally, it is possible to omit the charge elimination between the preceding development and the succeeding charge by the charge eliminating device 13.

Incidentally, in order to avoid the color mixing, it is advisable to set the d.c. biases for the developments sequentially at higher levels for the later developments or to reduce the amplitude of the a.c. component. It is also advisable to set the charge potentials sequentially at high levels in a corresponding manner.

The detail of the image forming conditions in the present embodiment will be described in the following.

The image retainer 1 had a surface layer of a photosensitive material such as CdS and a circumferential speed of 180 mm/sec. The surface of this image retainer 1 was charged to −500 V by means of the charger using the scorotron corona discharger, and the charged surface was exposed to the laser corresponding to the blue component of the image. As a result, the image retainer 1 was formed with the background in which the unexposed portion had a potential of −500 V whereas the exposed portion PH had an electrostatic image potential of −50 V. The electrostatic image thus formed was subjected to the first development by means of the developer 5 shown in FIG. 3.

The developer 5 used the developer, which is composed of: a carrier prepared by dispersing 50 wt % of magnetite into a resin to have an average particle diameter of 20 μm, a magnetization of 30 emμ/g and a resistivity of $10^{14}$ Ωcm or more; and a negatively charged non-magnetic toner prepared by adding 10 wt parts of benzidine derivative as the Yellow pigment and another charge control agent to styrene-acrylic resin to have an average particle diameter of 10 μm, under the condition in which the ratio of the toner to the carrier was 25 wt %. Moreover: the developing sleeve 31 had an external diameter of 30 mm and a number of revolutions of 100 r.p.m.; the magnet 32 had its N and S poles of a density of magnetic flux of 1,000 Gausses and a number of revolutions of 1,000 r.p.m.; the developer layer in the developing area had a thickness of 0.7 mm; the gap between the developing sleeve 31 and the image retainer 1 was 0.8 mm; and the non-contact jumping developing condition for applying a superposed voltage of a d.c. voltage of −400 V and an a.c. voltage of 3 KHz and 1,000 V was resorted to.

While the electrostatic image was being developed by the developing device 5, the other similar developing devices 6 to 8 shown in FIG. 3 were maintained in the state in which they were not in their developing operations. This was achieved by isolating the developing sleeve 31 from the power supply 39 into a floating state, by grounding the same to the earth, or by applying a d.c. bias voltage in the polarity opposite to that of the charge of the toner positively to the developing sleeve, and it is the most preferable to apply the d.c. bias voltage. Like the developing device 5, the developing devices 6 to 8 are developed under the non-contact jumping developing condition, but it is better to remove the developer layer on the developing sleeve 31 or to separate the developing sleeve 31 from the image retainer 1. The developing device 6 used the developer having the composition, in which the tonner of the developer of the developing device 5 was replaced by a toner containing polytungstophosphoric acid as the Magenta pigment in place of the Yellow pigment, and the developing device 7 used the developer having the composition in which the toner was likewise replaced by a toner containing copper phthalocyanine as the cyanogen pigment.

It is quite natural that a color toner composed of another pigment or dye can be used and that the orders of the colors to be developed and the developing devices can be suitably selected.

The surface of the image retainer 1 having been subjected to the first development was recharged to −600 V by operating the charge eliminating device 13 and the charger 2 (of which the former may be left inoperative). The surface thus recharged was subjected to a second image exposure with a laser beam corresponding to the green component of the image. Next, the surface thus exposed was subjected to a second development with the Magenta toner by means of the developing device 6 under the non-contact jumping developing condition in which a superposed voltage of a d c voltage of −500 V and an a.c. voltage of 3 KHz and 1,000 V was applied to the developing sleeve 31. Likewise, the surface thus developed was repeatedly subjected to both a charge by the laser beam corresponding to the red component of the image and a third development with the cyanogen toner by means of the developing device 7. Incidentally, in the development or developments subsequent to the second one, the amplitudes, frequencies, the time selections and so on of the d.c. bias component and the a.c. component of the voltage to be applied to the developing sleeve 31 were changed suitably in conformity with the changes, developing characteristics and color reproductivity of the surface potential of the image retainer 1. Especially the sequential rise in the d.c. bias together with the charge potential is effective for preventing the color mixing of the toners. When the third development was conducted to form a four-color image on the image retainer 1, this color image was made liable to be transferred by the pretransfer charger 9 and the pretransfer exposing lamp 10 so that it was transferred to the recording member P by the transfer device 11 and was fixed by the fixing device 12. The image retainer 1 from which the color image was transferred had its charge eliminated by the charge eliminating device 13 and had its surface cleared of its residual toner by the abutment of the cleaning blade **14*a* and the fur brush 14*b* of the cleaning device 14. The one cycle of the color image recording was completed at the instant when the surface formed with the color image passed the cleaning device 13**.

All the color images thus recorded repeatedly were so clear with their respective colors exhibiting sufficient densities that their misregistrations in the individual colors could not be recognized with the naked eyes.

Incidentally, as to the developer to be used in the present invention, the carrier and the toner are desired to have the following conditions.

First of all, the carrier will be described. The fact that the magnetic carrier particles are rounded improves the agitatability of the toner and the carrier and the carriability of the developer and further the charge controllability of the toner thereby to make it reluctant for the toner particles to aggregate with one another and the toner particles and the carrier particles to aggregate with each other. If the magnetic carrier particles have a large average particle diameter in the present invention, however, there may arise the problems: (a) Since the heads of the magnetic brush to be formed on the developing sleeve are coarse, the toner image is liable to become uneven even if the electrostatic image is developed while being vibrated by the electric field; and (b) Since the toner density at the heads becomes low, the development is not effected in a high density. In order to solve the problem (a), it is sufficient to reduce the average particle diameter of the carrier particles, and it has been found as a result of the experiments that the problem solving effect begins to appear with an average particle diameter not larger than 50 μm and that the problem (a) substantially disappears with an average particle diameter not larger than 30 μm. Moreover, the problem (b) is also eliminated as a result that the toner density of the heads are increased to effect the development in the high density by making the magnetic carrier finer for the problem (a). With the excessively fine carrier particles, however, there arise other problems: (c) the carrier particles will stick together with the toner particles to the surface of the image retainer: and (d) the carrier particles become liable to scatter. These phenomena have relations to the intensity of the magnetic field to act upon the carrier particles and accordingly to the intensity of magnetization of the carrier particles. According to the experiments, it has been revealed that the aforementioned tendencies begin to appear with an average carrier particle diameter not larger than 15 μm and become prominent with an average particle diameter not less than 5 μm. Moreover, the carrier particles having sticked to the surface of the image retainer (i.e., the photosensitive member) are ordinarily colored black and partially emigrate together with the toner onto the recording paper or the like to adversely affect the color image in a serious manner.

From the above reasoning, the magnetic carrier is preferred to have an average particle diameter not larger than 50 μm, more preferably not larger than 30 μm and not smaller than 5 μm, still more preferably not smaller than 15 μm under a proper condition and be rounded. Incidentally, the above-specified average particle diameter is the weight-averaged particle diameter which was measured with a Coulter counter (which is one of the products of the Coulter Electronics, Inc.).

The magnetic carrier particles thus far described are obtained by selecting the particle diameters of such particles by the well-known average particle diameter selecting means as are prepared: by making fine and preferably rounding the particles of a ferromagnetic or paramagnetic material such as metals such as iron, chromium, nickel or cobalt, or the compound or alloys such as ferrosoferric oxide, γ-ferric oxide, chromium dioxide, manganese oxide, ferrite or manganese-copper alloy similar to the magnetic carrier particles of the prior art as the magnetic material; preferably by coating the surfaces of those magnetic material particles with a resin such as styrene resin, vinyl resin, etyl resin, rosin-modified resin, acrylic resin, polyamide resin, epoxy resin or polyester resin or fatty acid wax such as palmitic acid or stearic acid; more preferably by pulverizing or granulating the particles of a resin or fatty acid was, which contained the magnetic fine particles in dispersion, into round particles.

Incidentally, as a result that the carrier particles are formed to have a round shape by the resin or the like, as has been described above, provides in addition to the aforementioned effects the effects that the developer layer formed on the developing sleeve becomes even and that a high bias voltage can be applied to the developing sleeve. More specifically, the fact that the carrier particles are rounded by the resin or the like provides the effects: (1) the carrier particles are generally liable to be magnetized and attracted in their longer axis direction but lose the directivity, if rounded, so that the developer layer is formed evenly to prevent the formation of an area having a locally low resistance and the unevenness in the layer thickness; and (2) the carrier particles are freed from the edge portion, which might otherwise be found in the carrier particles of the prior art, in accordance with the rise in their resistance and accordingly from any concentration of the electric field at the edge portion so that a high bias voltage, even if applied to the developing sleeve, will neither discharge the surface of the image retainer to disturb the electrostatic latent image nor break down. This capability of applying that high bias voltage means that the following effects can be sufficiently exhibited in case the phenomena under the vibratory electric field in the preferred mode of the present invention are effected by applying the vibratory bias voltage. The carrier particles having the effects thus far described may use the wax, as has been described above, but may preferably use the aforementioned resins from the standpoint of the durability of the carrier and more preferably use the insulating magnetic carrier particles having a resistivity not lower than $10^8$ Ωcm, especially not lower than $10^{13}$ Ωcm. The resistivity is a value which is obtained by tapping the particles in a container having a sectional area of 0.50 $cm^2$, by applying a load of 1 $kg/cm^2$ to the tapped particles, and by reading out a current value when a voltage to establish an electric field of 1,000 V/cm is applied between an electrode acting as a loading member and a bottom electrode. If that resistivity is low, there arise a problem that charges are implanted into the carrier particles to make it liable for the carrier particles to stick to the surface of the image retainer or that the bias voltage becomes liable to break down, even in case the bias voltage is applied to the developing sleeve.

Synthesizing the discussions thus far made, the magnetic carrier particles are properly conditioned at least such that they are rounded to have a longer-to-shorter axis ratio less than 3, such that they have no projections such as styluses or edge portions, and such that they have a resistivity not smaller than $10^8$ Ωcm, preferably $10^{13}$ Ωcm. Moreover, these magnetic carrier particles are prepared: by selecting magnetic particles as round as possible and by coating them with a resin for the round magnetic particles or the resin-coated made highly resistive; and by either rounding the magnetic fine particles selected, if possible, after the formation of dispersed resin particles or forming the dispersed resin particles by the spray dry method for the carriers containing the magnetic fine particles dispersed therein.

Next, the toner will be described in the following. As the average particle diameter of the toner particles of the two-component developer becomes smaller, generally speaking, the amount of charge is reduced qualitatively in proportion to the square of the particle diameter whereas the sticking force such as the van der Waals force is relatively increased, so that the toner particles become reluctant to leave the carrier particles. Once the toner particles stick to the non-image portion of the surface of the image retainer, moreover, they are not removed easily by the rubbing action using the magnetic brush of the prior art to invite the problem of fog. This problem becomes outstanding according to the magnetic brush developing method of the prior art when the average particle diameter of the toner particles is not larger than 10 μm. According to the present invention, however, that problem is solved by conducting the developing using the developer, i.e., the so-called "magnetic brush" in the vibratory electric field. More specifically, the toner particles having sticked to the developer layer are made liable to leave the developer layer and to migrate to and from the image and non-image portions of the surface of the image retainer by the vibrations given electrically. Since the lowly charged toner particles are hardly allowed to migrate to the image and non-image portions and to be rubbed by the surface of the image retainer moreover, they do not stick to the image retainer, even if they are frictionally charged, so that they may be exemplified even by the toner particles having a particle diameter of about 1 μm. This makes it possible to form a clear toner image of excellent reproductivity, which is developed in high fidelity from the electrostatic latent image. Since the vibratory electric field weakens the coupling between the toner particles and the carrier particles, still moreover, the sticking of the carrier particles to the image retainer surface following the toner particles is reduced. In the areas of the image and non-image portions, the toner particles having a large amount of charge vibrate under the vibratory electric field, and the carrier particles also vibrate in dependence upon the intensity of the electric field. As a result, the toner particles emigrate selectively to the image portion of the image retainer surface so that the sticking of the carrier particles to the image retainer surface is drastically reduced.

If the average particle diameter of the toner is enlarged, on the other hand, the image becomes prominently coarse, as has been described hereinbefore. For the development having a resolution of fine lines arrayed at a pitch of about 10 lines/mm, there ordinarily arises no practical problem with the toner having an average particle diameter of about 20 μm. If the toner made fine to have an average particle diameter not larger than 10 μm, however, the resolution is drastically improved to provide a clear and high-quality image which succeeds in reproduce the density difference and so on in high fidelity. From the foregoing reasoning, the proper condition is that the toner particle diameter is not larger than 20 μm or preferably 10 μm on an average. For the toner particles to follow the electric field, moreover, it is desired that the quantity of charge of the toner particles be more than 1 to 3 μc/g (or preferably 3 to 100 μc/g). In case the particle diameter is especially small, a large quantity of charge is required. On the other hand, the resistivity may be not smaller than $10^8$ Ωcm or preferably $10^{13}$ Ωcm.

Moreover, the aforementioned toner can be prepared by the same manner as that of the toner of the prior art. Specifically, it is possible to use the toner which is prepared by selecting the nonmagnetic or magnetic toner particles of round of unfixed shape in the toner of the prior art by average particle diameter selecting means. Of these, the toner particles are preferrably the magnetic particles containing the particles of a magnetic material, and especially the quantity of the magnetic fine particles is preferably not to exceed 60 wt % and is preferred to be as small as 30 wt % so as to ensure the clearness of the color. In case the toner particles contain the magnetic particles, they are influenced by the magnetic force of the magnet contained in the developing sleeve so that the even formability of the magnetic brush is better improved to prevent the fog and to make the toner particles reluctant to disperse. If the content of the magnetic material is excessive, however, the magnetic force with the carrier particles becomes too strong to obtain a sufficient developing density, and the magnetic particles come to appear on the surfaces of the toner particles to make the frictional charge control difficult and the toner particles liable to break and to aggregate with the carrier particles.

Summing up the foregoing discussions, the toner preferred in the image forming apparatus of the present invention is composed of particles having an average particle diameter not larger than 20 μm or preferably 10 μm, which can be prepared according to a method similar to the toner particle preparing method known in the prior art by using a resin described in connection with the carrier and the fine particles of a magnetic material and by adding a coloring component such as carbon and a charge controlling agent, if necessary.

In the image forming apparatus of the present invention, there is preferably used the developer in which the round carrier particles and toner particles described above are mixed at a ratio similar to that of the two-component developer of the prior art. With the developer used in the present invention, if necessary, there are mixed a fluidizing agent for fluidizing the particles and a cleaning agent effective for cleaning the image retainer surface. The fluidizing agent can be exemplified by colloidal silica, silicon varnish, metallic soap or non-ionic surface-active agent, and the cleaning agent can be exemplified by surface-active agent such as metallic salt of fatty acid, organic-radical substituted silicone or fluorine.

The foregoing is the condition for the developer, by which the turbidity of each color can be prevented. Next, the condition concerning the developing sleeve for developing the electrostatic image on the image retainer by forming a developing layer with that developer will be described in the following.

The developing sleeve to be used may be similar to that used in the developing method of the prior art for applying the bias voltage but may preferably be constructed such that a rotary magnet having a plurality of magnetic poles is mounted in a sleeve formed with a developer layer on its surface. In this developing sleeve, the developer layer to be formed on the surface of the sleeve is moved in a meandering manner by the turns of the rotary magnet so that it is fed sequentially with a new developer whereby the influences of a more or less unevenness, if any, of the thickness of the developer layer on the sleeve surface- can be sufficiently covered to raise no practical problem by the aforementioned meandering movements. Moreover, the carrying velocity of the developer by the turns of the rotary magnet or the sleeve is preferably equal to or faster then that of the image retainer. Still more over, the carrying directions by the turns of the rotary magnet and the sleeve are preferrably identical. This identical direction is superior in image reproduction to the case of the opposite directions, although not limitative thereto.

On the other hand, the thickness of the developer layer to be formed on the developing sleeve is preferred such that the developer having sticked is sufficiently scraped off to become an even layer by the thickness regulating blade, and the gap between the developing sleeve and the image retainer is preferably several tens to 2,000 μm. If the surface gap between the developing sleeve and the image retainer becomes far smaller than the several tens μm, it becomes difficult to form the heads of the magnetic brush which can exert an even developing action thereupon, and the toner particles cannot be supplied to the developing portion to fail to effect a stable development. If the gap far exceeds 2,000 μm, on the other hand, the opposed electrode effect drops so much that a sufficient developing density cannot be attained. Thus, if the gap between the developing sleeve and the image retainer becomes excessive, the thickness of the developer layer on the developing sleeve cannot be made proper. Within a range of the gap of several tens to 2,000 μm, on the contrary, the developer layer can be formed to have a proper thickness.

With this in mind, therefore, the gap and the thickness of the developer layer are especially preferably set under the condition that the heads of the magnetic brush in the state of no vibratory electric field are not in contact with but are close to and spaced by 10 to 500 μm from the surface of the image retainer. This is because the toner development of the latent image can be prevented from any swept traces by the rubbing action of the magnetic brush and from any fog.

Moreover, the development under the vibratory electric field may preferably resort to the application of the vibrating bias voltage to the developing sleeve. Still moreover, the bias voltage may be exemplified by the superposed voltage which is composed of the d.c. voltage for preventing the toner particles from sticking to the non-image portion and the a.c. voltage for making the toner particles liable to leave the carrier particles. Despite of this fact, however, the present invention should not be limited to those methods of applying the vibratory voltage to the sleeve or applying the superposed voltage composed of the d.c. and a.c. components.

Embodiment 2

Figure 6:
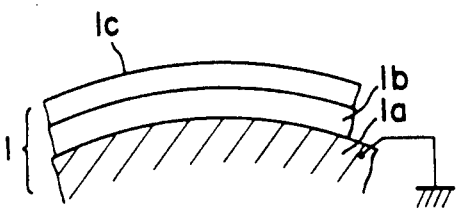
FIG. 6 is a sectional view showing one example of the structure of an image retainer.

In this embodiment, the charger 2 of the image forming apparatus of FIG. 1 is replaced by two chargers: a primary charger 102 having a combination of a lamp 102*a* for irradiating the surface of the image retainer 1 and a corona discharger 102*b*; and a secondary charger $10^3$ having a corona discharger. Incidentally, the image retainer 1 is constructed, as shown in FIG. 6, of: a conductive base member 1*a* made of aluminum, nickel or the like and grounded to the earth; a photoconductive and photosensitive layer 1*b* made of Se, CdS, Si or the like and formed on the conductive base member 1*a*; and a transparent insulating surface layer 1*c* made of a transparent resin and formed on the photosensitive layer 1*b*. The remainder is similar to the structure of the foregoing Embodiment 1.

Here, the primary charger 102 need not always be equipped with the lamp 102*a* if the photoconductive and photosensitive layer 1*b* of the image retainer 1 has such a semiconductor characteristic as exhibit a rectifying action of implanting charges from the base member 1*a*.

Figure 8:
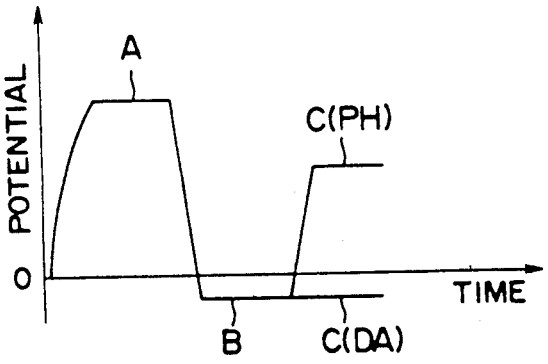
FIG. 8 is a chart showing the potential changes in a surface portion of the image retainer in a manner to correspond to FIG. 7.
Figure 7:
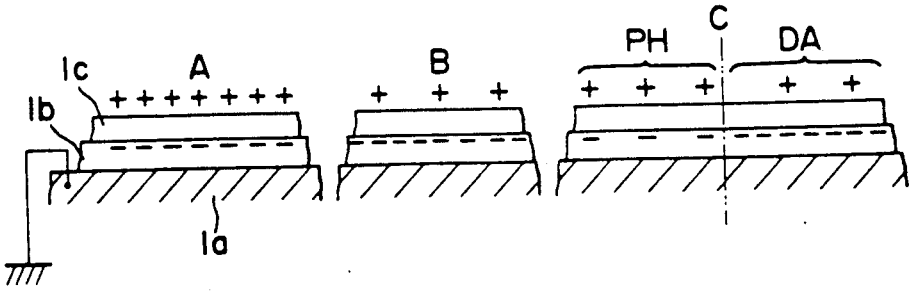
FIG. 7 is a charge state changing diagram showing one example of an electrostatic image forming process schematically.

In the image forming apparatus thus constructed, when the primary charger 102 conducts the corona discharge with its corona discharger 102*b* while irradiating the surface of the image retainer 1 with its lamp 102*a* (which may not be required, as has been touched above), the image retainer 1 has its photoconductive and photosensitive layer 1*b* and transparent insulating surface layer 1*c* charged at their surfaces, as shown at A in FIG. 7. When the surface of the image retainer 1 thus charged is subjected to the corona discharge by the secondary charger 103, then the charges on the surface of the transparent insulating surface layer 1*c* are reduced, because the photoconductive and photosensitive layer 1*b* has the insulating characteristic, so that the charges of the image retainer 1 change, as shown at B in FIG. 7. If the image exposing light 4 comes into the surface of the image retainer 1 having been subjected to the secondary charge, the surface charges of the photoconductive and photosensitive layer 1*b* has its surface charges reduced at its portion PH but not left as they are at the unexposed portion DA so that the charges of the image retainer 1 are changed, as shown at C in FIG. 7. The changes of the surface potential of the image retainer 1 in this meanwhile are shown in FIG. 8, in which the potentials in the states A, B and C correspond to the charged states A, B and C of FIG. 7, respectively. More specifically, the potential of the exposed portion PH having been exposed to the light 4 takes the surface potential shown at C(PH) in FIG. 8 whereas the potential of the unexposed portion DA having received none of the light 4 is C(DA) substantially equal to the surface potential shown at B in FIG. 8 so that an electrostatic image having the surface potential shown at C(PH) is formed with respect to the background potential by the action of the image exposing light 4. This electrostatic image can be developed like the ordinary electrophotographic copying machine with the developer for charging the exposed portion PH with a polarity opposite to that of the latent image, and this development is conducted by such one of the developing devices 5 to 8 as has a color corresponding to the image exposing light having formed that electrostatic image. When the development is effected to apply the toner, the potential of the electrostatic image drops in accordance with the sticking quantity of the toner charged to have the opposite polarity. Despite of this fact, however, the charges of the unexposed portion DA of the image retainer 1, which have not been exposed to the light 4, remain in the state shown at DA of C identical to B of FIG. 7, and the surface potential at that portion remains at the potential of C(DA) substantially identical to B of FIG. 8 even with the dark decay. As a result, if the image exposing light 4 in another color is made incident upon the second turn of the image retainer 1 with a misregistration from the position of the preceding light 4, the electrostatic image can be formed like the preceding step with neither of the aforementioned primary nor secondary charges. Thus, the formation of the second or subsequent electrostatic images by making use of the first primary and secondary charges can be easily effected in case the preceding development is conducted by the developing method, in which the developer for charging of opposite polarity is caused to stick to the latent image, and under the non-contact jumping developing condition. This is partly because the sticking of toner to the electrostatic image is effected more easily than the developing method, in which the developer for charging of identical polarity is caused to stick to the electrostatic image, to make it unnecessary to apply a high voltage for the toner to stick to the electrostatic image to the developing sleeve 31 so that the charged state of the image retainer 1 can be maintained stable, and partly because the developer layer of the developing device will not come into contact with the surface of the image retainer 1 thanks to non-contact jumping developing condition so that the charged state of the image retainer 1 can be maintained stable. Incidentally, the aforementioned misregistration of the image exposing light 4 relative to the preceding light 4 so as to form the electrostatic images for the different colors can be easily effected by making use of the aforementioned laser beam scanner of FIG. 2 or the like for emitting the image exposing light 4.

The present invention should not limited to the example, in which the second and subsequent electrostatic image formations are undergone by making use of the first primary and secondary charges, but can generally be exemplified by the primary and secondary charges again upon each of the second and subsequent electrostatic image formations, or either by eliminating the preceding charges by the charge eliminating device 13 or by conducting the secondary charge in a manner to erase the preceding electrostatic image and to compensate the dark decay before each of the second and subsequent electrostatic image formations. Especially in case either the primary and secondary charges or only the secondary charge is undergone again without eliminating the preceding charges, the scorotron corona discharger capable of stabilizing the charging operation even in the presence of the preceding charges may preferably used as the corona dischargers of the primary charger 102 and the secondary charger 103. The repeated executions of the primary and secondary charges upon each formation of the electrostatic image are desired especially in case the gradation reproductivity is stressed or in case the image exposing light 4 is slit or flashed. On the other hand, the NP or KIP method can be adopted, in which the electrostatic image is formed by conducting the image exposure simultaneously with the secondary charge after the primary charge and by subsequently conducting the exposure of the whole surface. In the several methods thus far described, the potential of the electrostatic image can be so controlled in dependence upon the relative intensities of the primary and secondary charges that the exposed portion and the unexposed portion may take identical or opposite polarities, but the latter, i.e., the opposite polarities are preferred taking the easiness of development into consideration.

The electrostatic image thus formed upon the second turn is developed by such one of the developing devices 5 to 8 as has a color corresponding to that of the image exposing light 4 forming it but different from the color of the previous development. Likewise, upon the third turn of the image retainer 1, too, the formation of the electrostatic image and the development of the electrostatic image but by another developing device are conducted to form a color image in which toner images in different colors are superposed on the image retainer 1. Moreover, the surface of the image retainer 1 thus subjected to the final development has its toner images charged, if necessary, by the corona discharger and further irradiated by the pretransfer lamp 10 so that the color image can be easily transferred to the recording member P by means of the transfer device 11. The color image thus transferred to the recording member P is fixed to the recording member P by means of the fixing device 12. The surface of the image retainer 1, from which the color image has been transferred, has its charges eliminated by means of the charge eliminating device 13 and has its residual toners removed by the abutment of the cleaning blade 14*a* and the fur brush 14*b* of the cleaning device 14, which have been apart therefrom until that time. At the instant when that surface portion of the image retainer 1, which has been formed with the color image, passes the cleaning device 14, the one color image recording cycle is completed by the separations of the cleaning blade 14*a* and the fur brush 14*b* from the surface of the image retainer 1.

Figure 9:
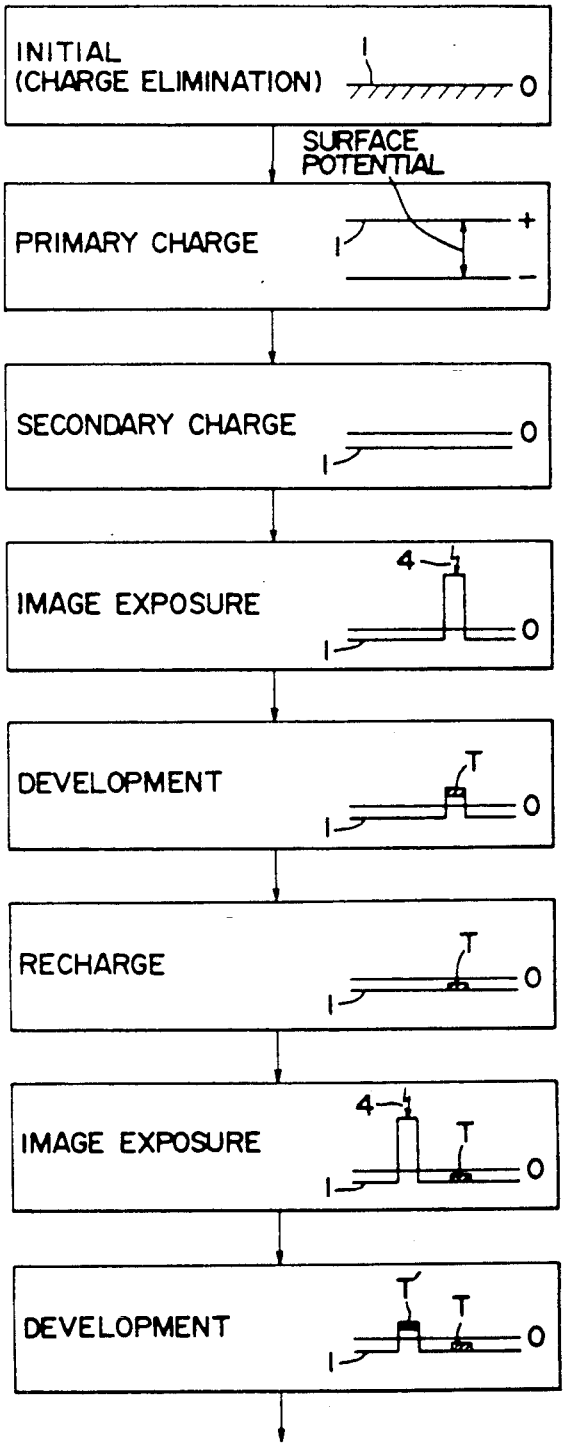

FIG. 9 is a flow chart showing the changes in the surface potential of the image retainer according to the embodiment in which the electrostatic image is formed through the every-time image exposure making use of the first primary and secondary charges. In the shown example of the electrostatic image formation of the present invention, there is formed in the exposed portion the electrostatic image, to which the toner is caused to stick, as shown in FIGS. 7 and 8.

The detail of the condition for forming the image in this example will be described in the following.

The image retainer 1 was constructed of a photosensitive layer of CdS having a thickness of 30 μm and a transparent insulating layer having a thickness of 20 μm and formed on the photosensitive layer and was made to have a circumferential velocity of 180 mm/sec. This image retainer 1 was so charged while being uniformly exposed with the lamp 102*a* of the primary charger 102 that its surface potential was given +1,000 V by the d.c. scorotron corona discharger 102*b*. Next, the image retainer 1 was charged to have a surface potential of −100 V by means of the secondary charger 103 constructed of the scorotron corona discharger having an a.c. component. The resultant charged surface was subjected to a writing exposure in a density of 16 dots/mm by means of the laser beam scanner using the He-Ne laser, as shown in FIG. 2, to form an electrostatic image whose exposed portion had a potential of +300 V whereas its background had a potential of −100 V. This electrostatic image was developed by means of the developing device 5 shown in FIG. 3.

The developer 5 used the developer, which is composed of: a carrier prepared by dispersing 50 wt % of magnetite into a resin to have an average particle diameter of 30 μm, a magnetization of 30 emu/g and a resistivity of $10^{14}$ Ωcm or more; and a negatively charged non-magnetic toner prepared by adding 10 wt parts of benzidine derivative as the Yellow pigment and another charge control agent to styrene-acrylic resin to have an average particle diameter of 10 μm, under the condition in which the ratio of the toner to the carrier was 20 wt %. Moreover: the developing sleeve 31 had an external diameter of 30 mm and a number of revolutions of 100 r.p.m.; the magnet 32 had its N and S poles of a density of magnetic flux of 900 Gausses and a number of revolutions of 1,000 r.p.m.; the developer layer in the developing area had a thickness of 0.7 mm; the gap between the developing sleeve 31 and the image retainer 1 was 0.8 mm; and the non-contact jumping developing condition for applying a superposed voltage of a d.c. voltage of −50 V and an a.c. voltage of 2.5 KHz and 2,000 V was resorted to.

Incidentally, while the electrostatic image was being developed by the developing device 5, the other similar developing devices 6 to 8 shown in FIG. 3 were maintained in the state in which they were not in their developing operations. This was achieved by isolating the developing sleeve 31 from the power supply 39 into a floating state, by grounding the same to the earth, or by applying a d.c. bias voltage in the polarity identical to that of the electrostatic image, i.e, opposite to that of the charge of the toner positively to the developing sleeve 31, and it is the most preferable to apply the d.c. bias voltage. Since the developing devices 6 to 8 are developed like the developing device 5 under the non-contact jumping developing condition, it is unnecessary to remove the developer layer on the developing sleeve 31. The developing device 6 used the developer having the composition, in which the toner of the developer of the developing device 5 was replaced by a toner containing polytungstophosphoric acid as the Magenta pigment in place of the Yellow pigment; the developing device 7 used the developer having the composition in which the toner was likewise replaced by a toner containing copper phthalocyanine derivative as the cyanogen pigment; and the developing device 8 used developer having the composition in which the toner was likewise replaced by a toner containing carbon black as the black pigment. It is quite natural that a color toner composed of another pigment or dye can be used and that the order of the colors to be developed can be suitably selected to form a clear color image. Especially in case the positions of the image exposures are overlapped, the order of the colors to be developed has to be carefully determined because it has a serious relation to the cleanness of the color image.

The surface of the image retainer 1 having been developed by the developing device 5 then passed the pretransfer charger 9 and the pretransfer lamp 10, which were not required until the transfer at last, and further the charge eliminating device 13 and the cleaning device 14, which were held in their inoperative states, and was recharged by the primary charger 102 and the secondary charger 103 which came into their rest states after their aforementioned primary and secondary charging actions. The surface of the image retainer 1 was then subjected to the second writing operation with shifted positions but the same density of the dots by means of the same laser beam scanner as that of the preceding exposure when it reached the position in which it could receive the image exposing light 4 again. The electrostatic image thus formed had a potential of +300 V with respect to the potential of the background of −100 V. The resultant electrostatic image was developed by means of the developing device 6 under the same condition as that of the developing device 5 except that a voltage having a d.c. component of −50 V and an a.c. component of 2.5 KHz and 2,000 V was applied to the developing sleeve 31.

Likewise, the image retainer 1 was subjected upon its third turn to the writing operation by the laser beam scanner to form an electrostatic image having a potential of +300 V with respect to that of the background of −100 V. This image was developed by the developing device 7 under the same condition as that of the developing device 5 except that a voltage having a d.c. component of −50 V and an a.c. component of 2.5 KHz and 2,000 V was applied to the developing sleeve 31. Likewise, moreover, the image retainer 1 was subjected upon its fourth turn to the writing operation with a twice amount of light at first by means of the laser beam scanner to form an electrostatic image having a potential of +500 V with respect to that of the background of −100 V. This electrostatic image was developed by the developing device 8 under the same condition as that of the developing device 5 except that a voltage having a d.c. component of 200 V and an a.c. component of 2.5 KHz and 2,000 V was applied to the developing sleeve 31.

At the stage when that fourth development was conducted to form a four-color image on the image retainer 1, the pretransfer charger 9 and the pretransfer lamp 10 were operated to make the color image liable to be transferred. This color image was transferred to the recording member P and fixed by the fixing device 12.

The image retainer 1 from which the color image was transferred had its charges eliminated by the charge eliminating device 13 and had its surface cleared of its residual toner by the abutment of the cleaning blade 14*a* and the fur brush 14*b* of the cleaning device 14. The one cycle of the color image recording was completed at the instant when the surface formed with the color image passed the cleaning device $1^4$.

All the color images thus recorded repeatedly were so clear with their respective colors exhibiting sufficient densities that their misregistrations in the individual colors could not be recognized with the naked eyes.

As to the aforementioned Embodiments 1 and 2, the position of the cleaning device 14 was changed, and the abutment of the cleaning blade 14*a* and the fur brush 14*b* against the image retainer 1 was started immediately after the end of the final development or released immediately before the initial charging operation. Neither the misregistration of the color image of the different colors nor the changes in the image densities were observed so that a color image of higher quality was formed.

Figure 10:
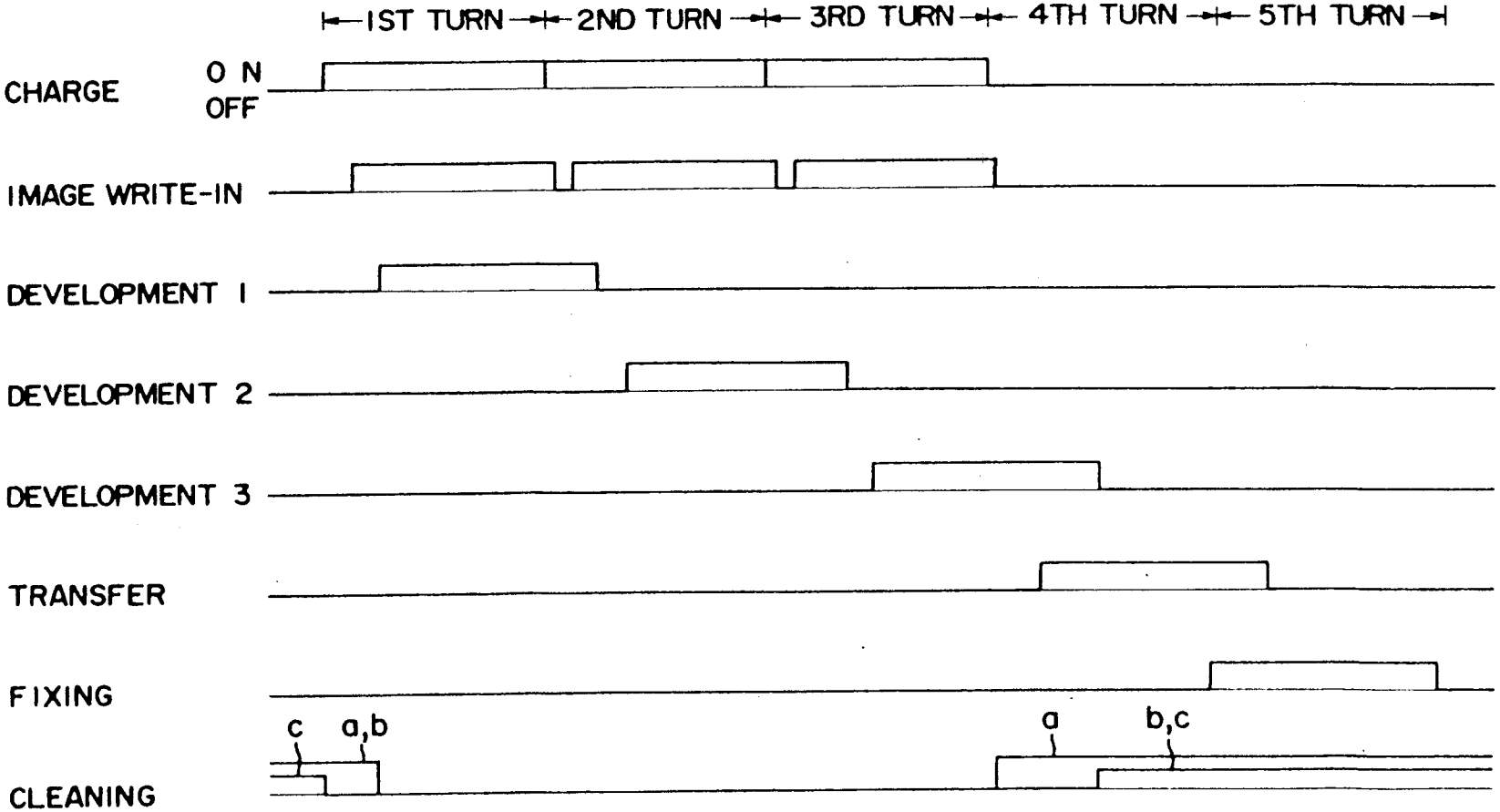
FIGS. 10, 12 and 13 are timing charts showing the operations of the individual portions of the image forming apparatus.

By taking up the Embodiment 1 as an example, the image forming process is shown by a timing chart in FIG. 10. In FIG. 10: a curve a indicating the cleaning operation shows an example in which the operation of the cleaning device was started immediately after the final formation of the latent image; a curve b shows an example in which the above-specified operation was started immediately after the final development; and a curve c shows in addition to the example of the curve b an example in which the same operation was released immediately before the initial charge.

Figure 11:
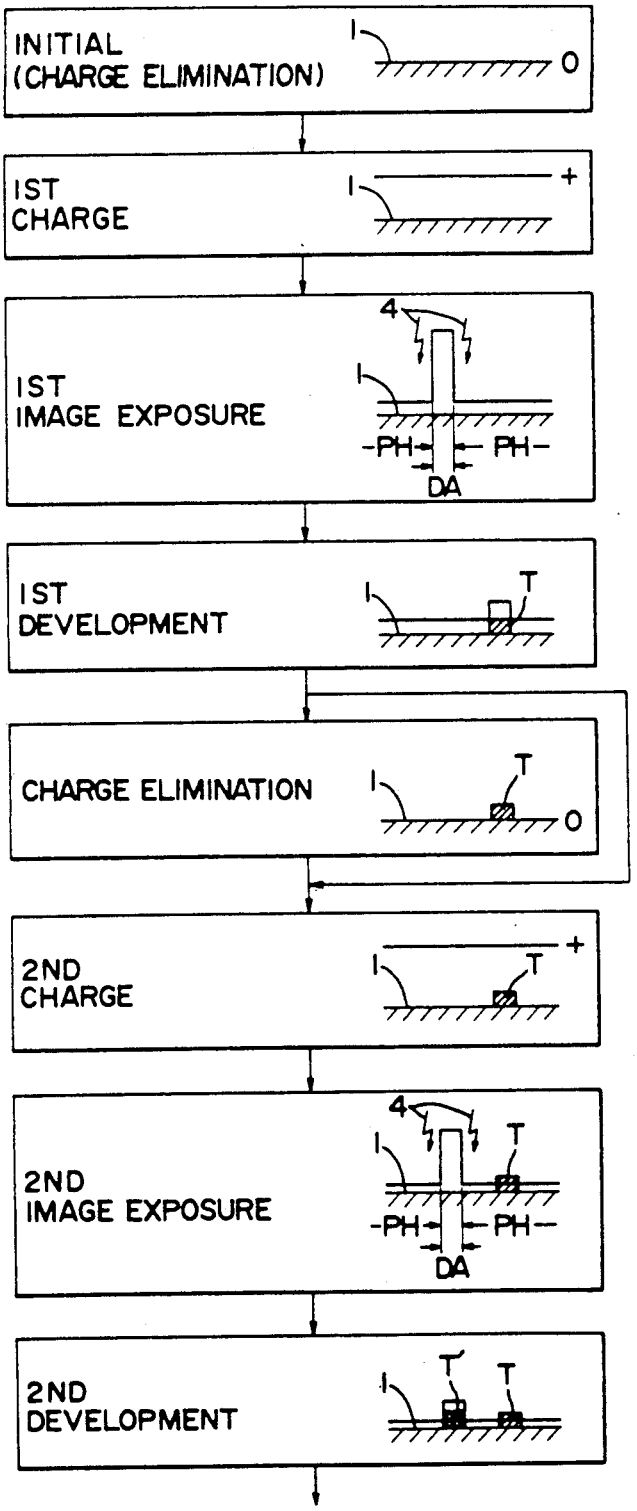
Figure 14A:
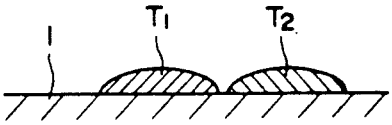
FIG. 14(A) PRIOR ART
FIGS. 14(A), 14(B) and 14(C) are sectional views showing the toner sticking situations in the respective image forming operations of the prior art.
Figure 14B:
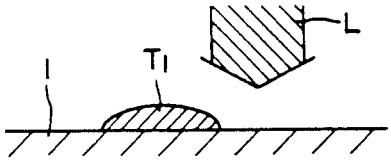
FIG. 14(B) PRIOR ART
Figure 14C:
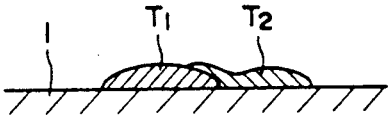
FIG. 14(C) PRIOR ART
Figure 15:
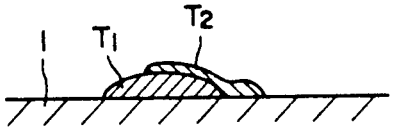
FIG. 15 PRIOR ART
FIGS. 15 and 16 are sectional views showing other toner sticking situations of the prior art.
Figure 16:
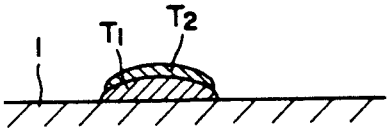
FIG. 16 PRIOR ART

Incidentally, the image forming process can be exemplified by the method in which the latent image is formed by the electrostatic image forming method forming the exposed portion PH into the background and the unexposed portion DA into the electrostatic image, as shown in FIG. 11, contrary to the foregoing one (shown in FIGS. 4 and 9).

Figure 12:
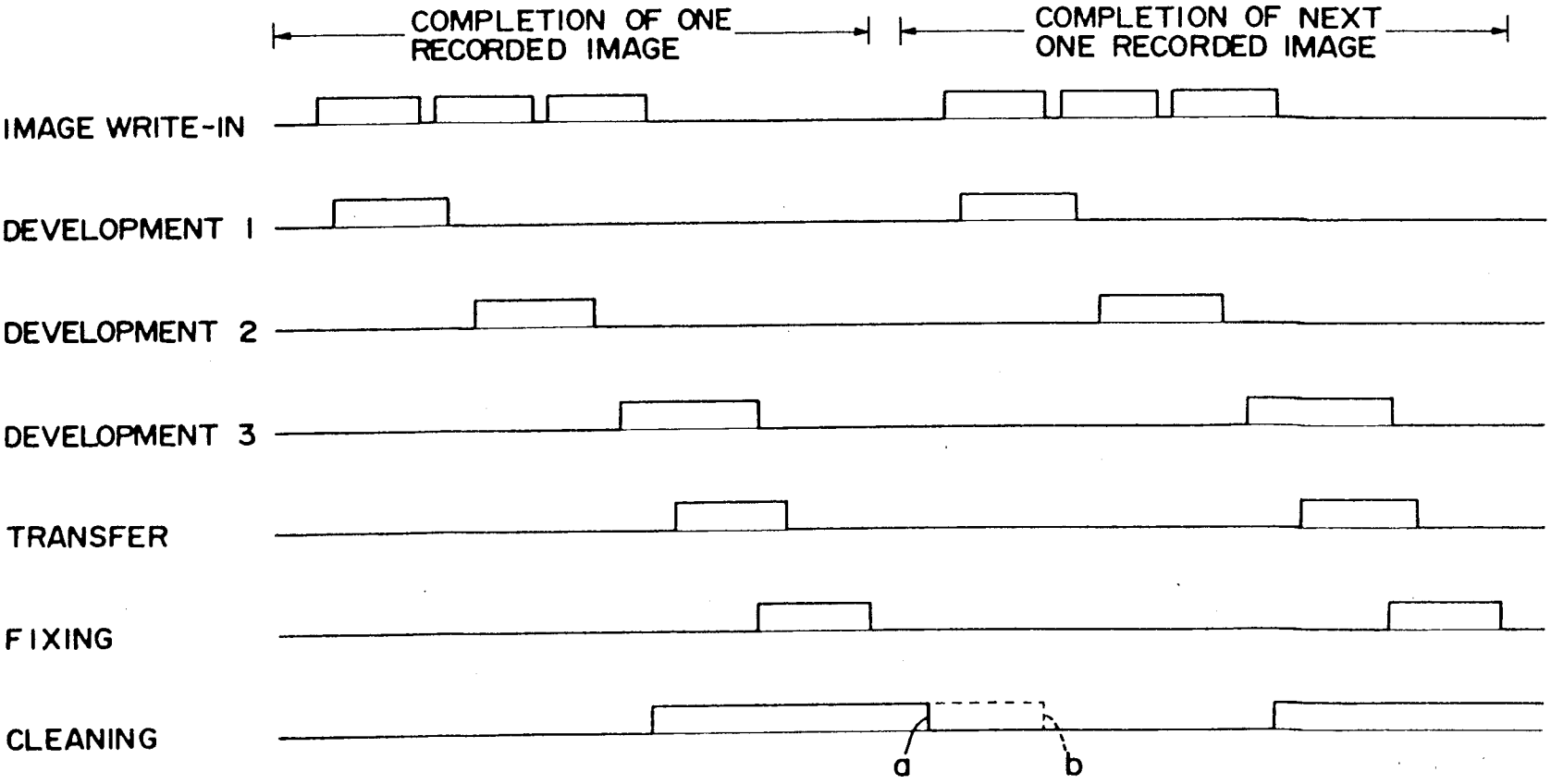
Figure 13:
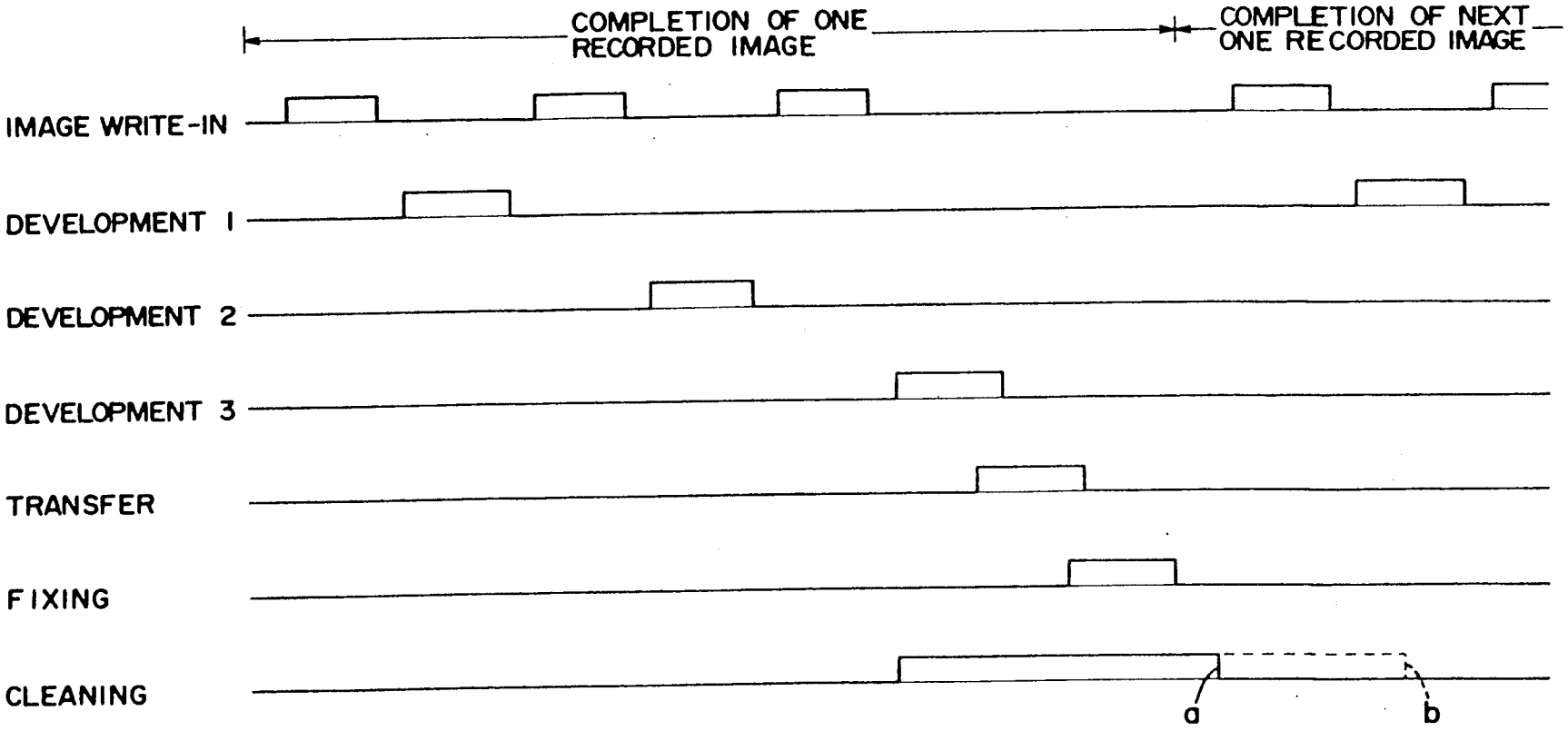

On the other hand, the release of the cleaning member from abutment against the image retainer may be conducted not only before the first image writing operation for the next recording image formation, as shown by a solid curve a in the timing chart of FIG. 12, but also between the image writing operation for the next recording image formation, as shown by a broken curve b, and the next image writing operation. As shown in FIG. 13, moreover, the development can be conducted for a period between the image writing operation under consideration and the next image writing operation, and the release of the cleaning member from abutment against the cleaning member can be conducted like FIG. 12 either before the first image writing operation for the next recording image formation, as shown by a solid curve a or between the image writing operation for the next recording image formation, as shown by a broken curve b, and the next image writing operation.

Figure 5:
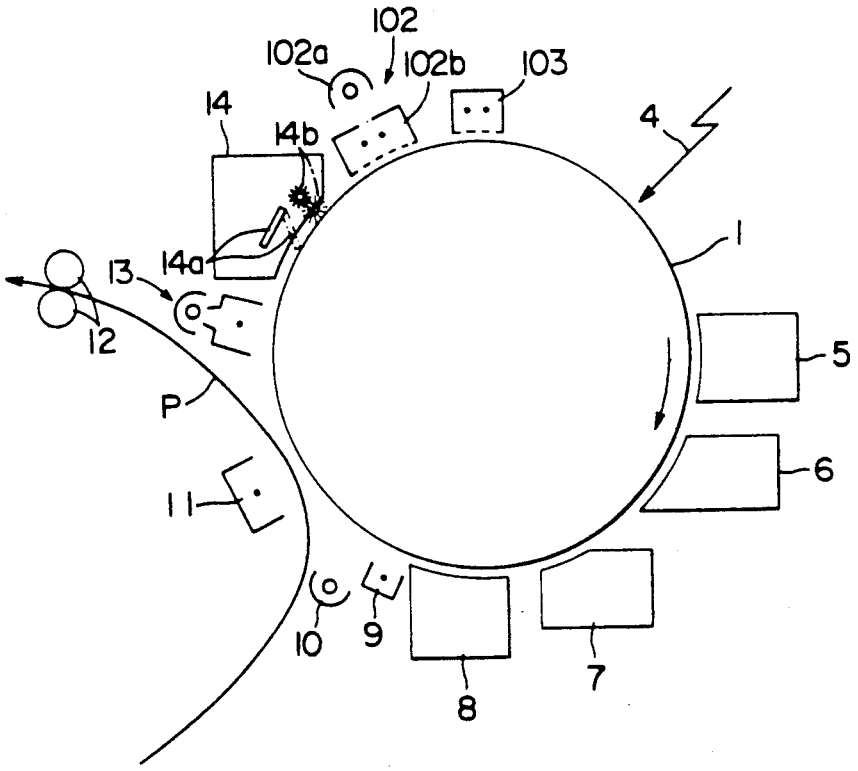

In FIGS. 10, 12 and 13, moreover, the development was conducted with the Yellow, Magenta and Cyan toners by means of the three (which may be all) of the developing devices 5, 6, 7 and 8 shown in FIGS. 1 and 5 to make a black color with those three colors. This black color can be exhibited more clearly if all the four developing devices are used by additionally using a black toner. In this modification, the turns of the image retainer 1 for obtaining the recorded image is four for one cycle.

Thus, in the aforementioned examples, all the recorded images obtained are clear with a sufficient density but without any color misregistration, and no spare time to turn the image retainer only for the cleaning operation having no relation to the image formation is required for continuously forming the recorded images after all the processes except the cleaning operation have been ended.

Another embodiment of the color image forming apparatus according to the present invention will be described in the following with reference to FIGS. 17 to 21.

Figure 17:
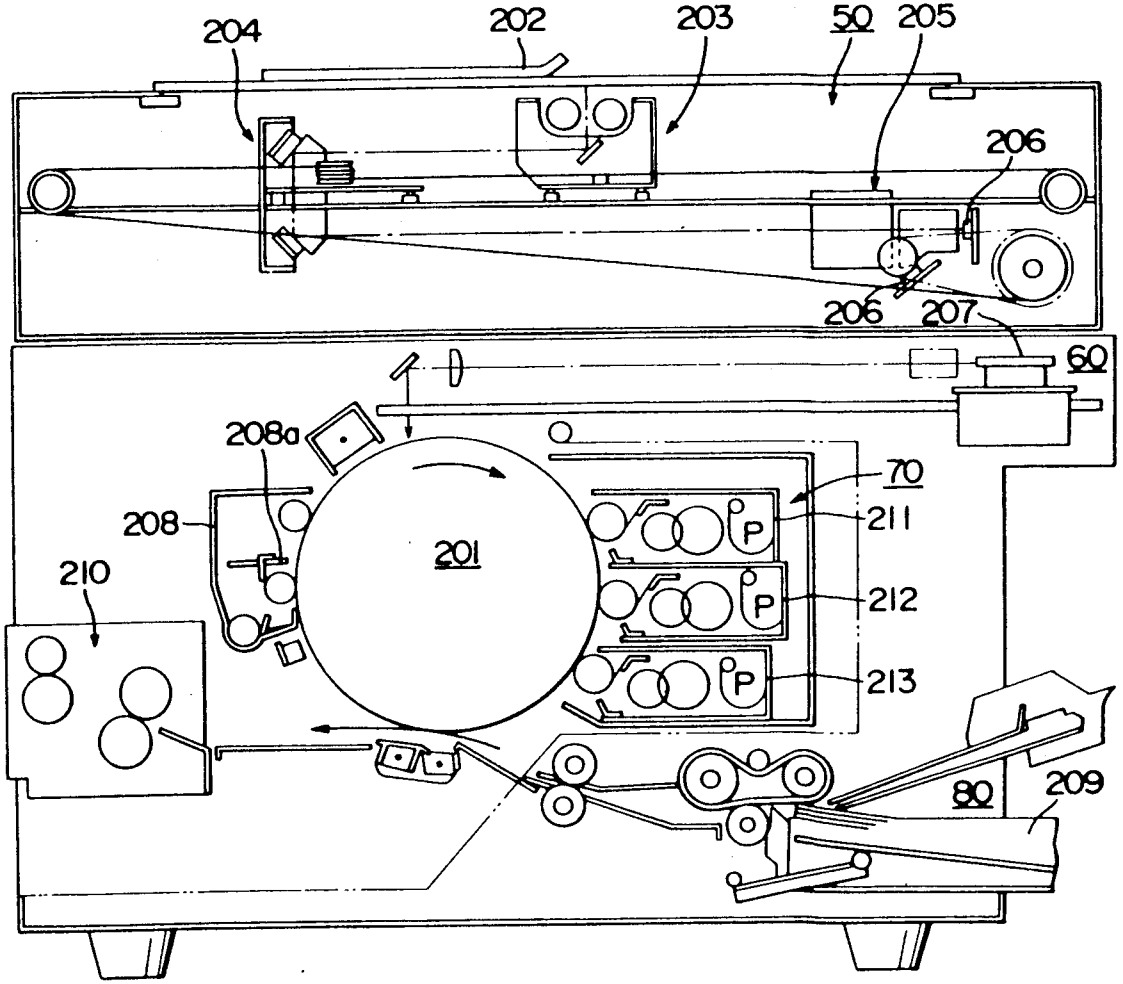
FIG. 17 is a sectional view showing the structure of a color image forming apparatus to which the present invention is applied.

FIG. 17 shows the overall structure of the aforementioned color image forming apparatus, in which: reference numeral 50 indicates a read-out unit for exposing and scanning the image of an original 202 by means of a moving optical system; numeral 60 a write-in unit acting as write-in means for writing the image signals, which are sent from the aforementioned read-out unit 50, in a photosensitive drum 201 acting as the image retainer to form a latent image; numeral 70 a plurality of developing means or developing devices disposed for forming the aforementioned latent image into a toner image; and numeral 80 a paper feeding unit stored with recording paper or a member to which the aforementioned toner image is to be transferred.

In the read-out unit 50, the original 202 is exposed and scanned by a moving mirror unit 203 of the moving optical system so that its image is sent to a lens read-out unit 205 and then has its color separated into a plurality of wavelength regions until its respective color images are focused on image sensors 206.

The image signals in the individual colors are sent out from the aforementioned image sensors 206 to the aforementioned write-in unit 60 and are projected on the circumference of the aforementioned photosensitive drum 201 through an optical system including a polygonal mirror 207 by the laser beam which is generated by a semiconductor laser.

When the scanning is started, the beam is detected by an index sensor and is begins to be modulated by a first color signal to scan the photosensitive drum 201 which has been uniformly charged in advance. A latent image corresponding to a first color is formed on the drum surface by the main scanning with the laser beam and by the auxiliary scanning resulting from the turns of the photosensitive drum 201. This latent image is developed to form a toner image on the drum surface by a developing device 211, which is charged with a red toner, for example. The first developing device 211 to develop the latent image corresponding to that first color is arranged closest to the aforementioned photosensitive drum 201 in the direction in which said photosensitive drum 201 moves. The toner image thus obtained passes, while being retained on the drum surface, below a blade member 208*a* of a cleaning device 208, which is positioned apart from the surface of the photosensitive drum 201. The toner image is then charged again to form a latent image in response to the second color signal like the case of the aforementioned first color signal. This latent image is developed by a second developing device 212 corresponding thereto and charged with a blue toner, for example. Moreover, the latent image of the third color signal is also developed by a third developing device 213 charged with a black toner, for example. Thus, the color toner image is formed by composing those toner images of those individual monochromatic colors. The aforementioned second and third developing devices 212 and 213 are arranged in the recited order subsequent to the aforementioned first developing device 211 with respect to the moving direction of the photosensitive drum 201.

Figure 18:
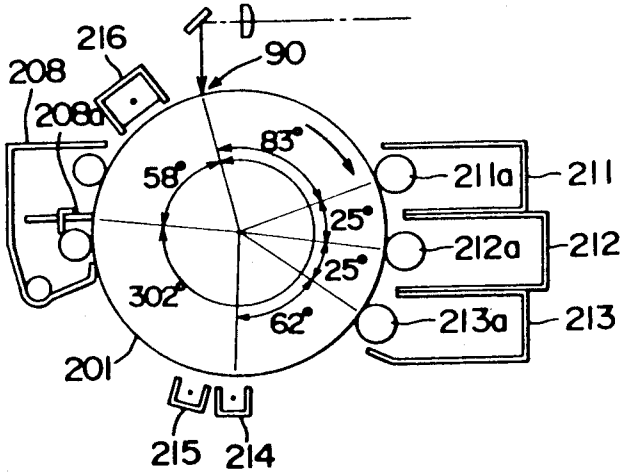
FIG. 18 is a view showing an essential portion of the same.

As shown in FIG. 18, moreover, subsequent to the aforementioned developing devices 211, 212 and 213 in the moving direction of the photosensitive drum 201, there are arranged transfer and separation electrodes 214 and 215, and charging electrode 216 and an exposing point 90 from the write-in unit 60 by way of the aforementioned cleaning device 208. As a result, the color toner image formed on the circumference of the photosensitive drum 201 is transferred to the recording paper fed from the aforementioned paper feed cassette 209 and is separated. After this, the drum 201 has its residual toner scraped and swept by that blade member 208*a* of the aforementioned cleaning device 208, which has been switched to its abutting state, and is then charged again for a process for forming a new original image.

As to the position of the exposing point 90 by the aforementioned write-in unit 60 relative to the circumferential edge of the photosensitive drum 201 and the abutting position of the blade member 208*a* of the aforementioned cleaning device 208, in the present invention, the circumferential length from the exposing point 90 through the transfer electrode 214 to the abutting position of the blade member 208*a* is made slightly larger than the maximum length of the recording paper to be transferred, whereas the circumferential length from the blade member 208*a* through the charging electrode 216 to the exposing point 90 is made slightly smaller than the minimum frame interval (which corresponds to the non-image area). Although the cleaning device in this description will be concerned mainly with the blade member, the present invention should not be limited thereto but can be exemplified by such a cleaning device using a fur brush or web that the turning velocity of the photosensitive member is influenced by the start or end of the cleaning action. Thus, the operations of bringing the blade member 208*a* of the cleaning device 208 into or out of abutment during the exposing operation, or the exposure starting or ending operation during the cleaning operation can be avoided so that the images corresponding to the respective colors can be projected through the uniform exposing and scanning operations by the stable circumferential velocity of the photosensitive drum 201.

Figure 19A:
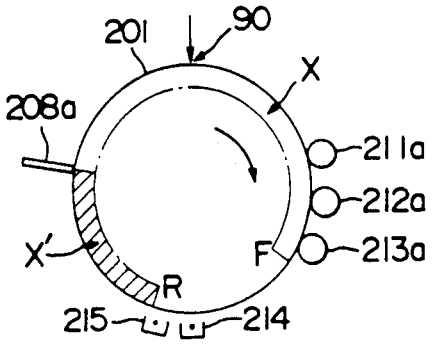
Figure 19B:
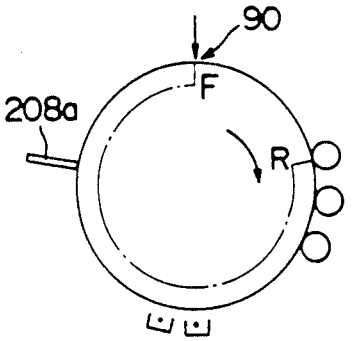

The individual processes will be described with reference to FIGS. 19 and 20. FIG. 19*a* shows the step at which a front half X of the preceding image on the circumference of the photosensitive drum 201 turning in the direction of arrow is cleaned by the cleaning action of the blade member 208*a* and is cleared of the residual toner and at which the cleaning operation of the rear half X' is then started. FIG. 19*b* shows the states in which the next exposure of the image corresponding to the first color of the original is to be started.

Figure 19C:
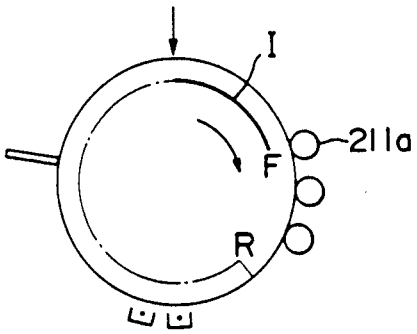
Figure 19D:
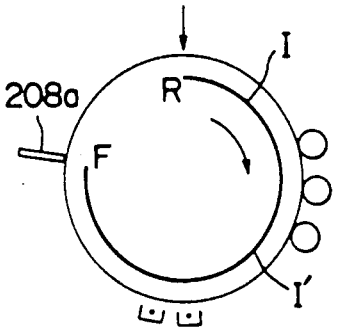
Figure 19E:
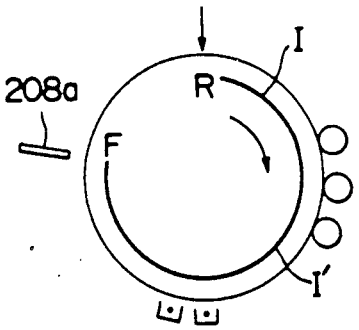
Figure 19F:
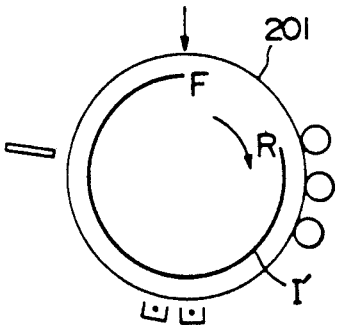
Figure 19G:
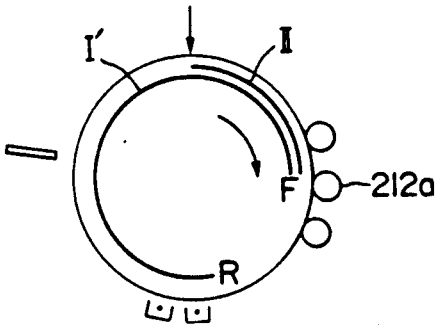
Figure 19H:
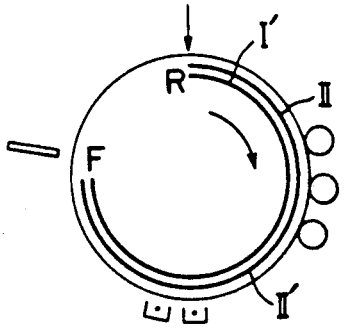
Figure 20I:
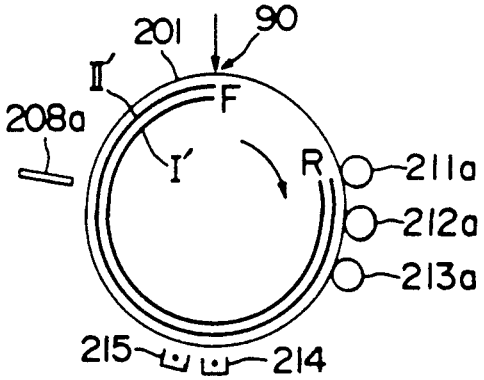
Figure 20J:
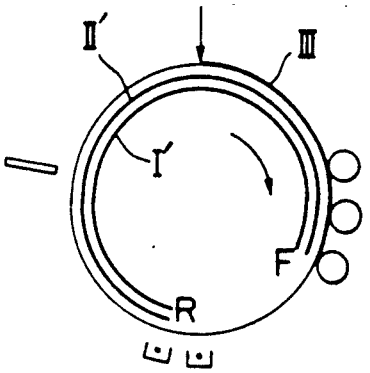
Figure 20K:
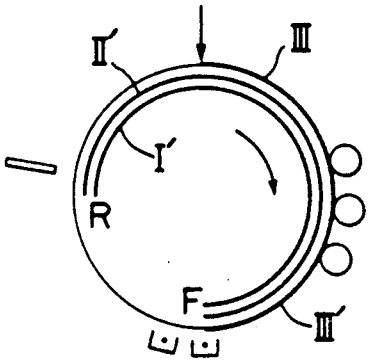
Figure 20K:
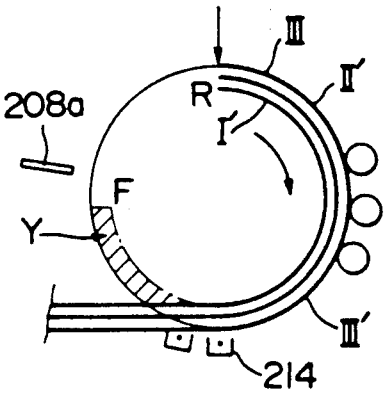

When a latent image I corresponding to the first color is formed by the aforementioned exposure so that its leading end F reaches the position of a developing sleeve 211*a* of the developing device 211 (as shown in FIG. 19*c*), the latent image I is developed to form a toner image I'. Since the leading end F of the aforementioned toner image I' does not reach the abutting position of the blade member 208*a* yet but is positioned slight in front of the same by the construction of the present invention even at the instant when the exposure of the rear end R of the aforementioned latent image I is ended (as shown in FIG. 19*d*), the abutment of the aforementioned blade member 208*a* is released in that meanwhile and is passed by the aforementioned toner image I' (as shown in FIG. 19*e*). As a result, during the formation of the latent image I corresponding to the first color, the aforementioned blade member 208*a* is left in its abutting state and inoperative so that the photosensitive drum 201 continues its stabilized uniform turns. Subsequently, the photosensitive drum 201 is charged to start the formation of a latent image II corresponding to a second color on the aforementioned toner image I' (as shown in FIG. 19*f*). Likewise, the front end F of the latent image II reaches the developing sleeve 212*a* of the developing device 212 so that it is developed to form a toner image II' sequentially (as shown in FIG. 19*g*). This toner image II' passes below the blade member 208*a* which is released from its abutting state (as shown in FIG. 19*h*). Through a similar- process (as shown in FIG. 20*i*), again, the a latent image III corresponding to a third color and then a toner image III' are formed (as shown in FIG. 20*j* and 20*k*). These images are composed with the aforementioned toner images I' and II' to form a multi-color toner image. After this color toner image has begun to be transferred to the recording paper by the transfer electrode 214, the exposure of the trailing end R of the aforementioned latent image III is ended before the leading end F of the residual toner of the photosensitive member surface reaches the position corresponding to the abutment of the blade member 208*a* (as shown in FIG. 20*l*).

Figure 20M:
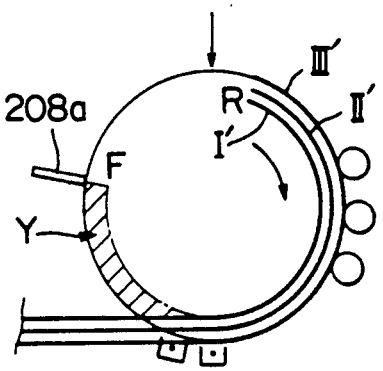
Figure 20N:
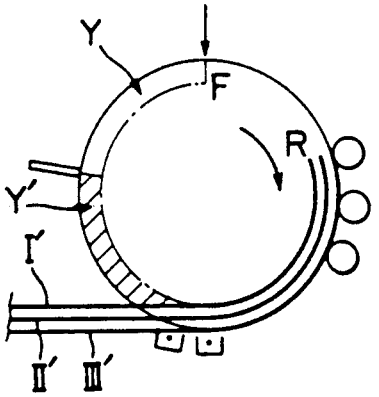

As a result, while both the latent images II and III corresponding to the second and third colors, respectively, are being formed, the aforementioned blade member 208*a* is in the state released from its abutment and does not start its abutting action so that the photosensitive drum 201 can continue its stabilized uniform turns. Next, before the leading end F of the aforementioned residual toner reaches the blade member 208*a*, this blade member 208*a* comes into its abutting state (as shown in FIG. 20*m*) so that the residual toner is removed sequentially from a front half Y to a rear half Y'. In the case of the continuous copy, the charging and exposing operations for the succeeding copy are started without turning the photosensitive drum 201 idly (as shown in FIG. 20*n*).

With the external diameter of the outer circumference of the photosensitive drum 201 being set at 140 mm and with the maximum recording paper to be used being set to have a size B4 (having a length of 364 mm), if the positions of the exposing point 90 and the blade member 208*a* satisfying the present invention are expressed by the following equations, as shown in FIG. 2:

$$\pi \cdot 140\ \text{mm} \times 302^\circ/360^\circ = 369\ \text{mm} > 364\ \text{mm; and}$$

$$\pi \cdot 140\ \text{mm} \times 58^\circ/360^\circ = 71\ \text{mm} < (\pi \cdot 140 - 364)\ \text{mm.}$$

From the above equations, the distance between the exposing point 90 and the blade member 208*a* becomes shorter than the length of the non-image portion on the circumference.

Figure 21:
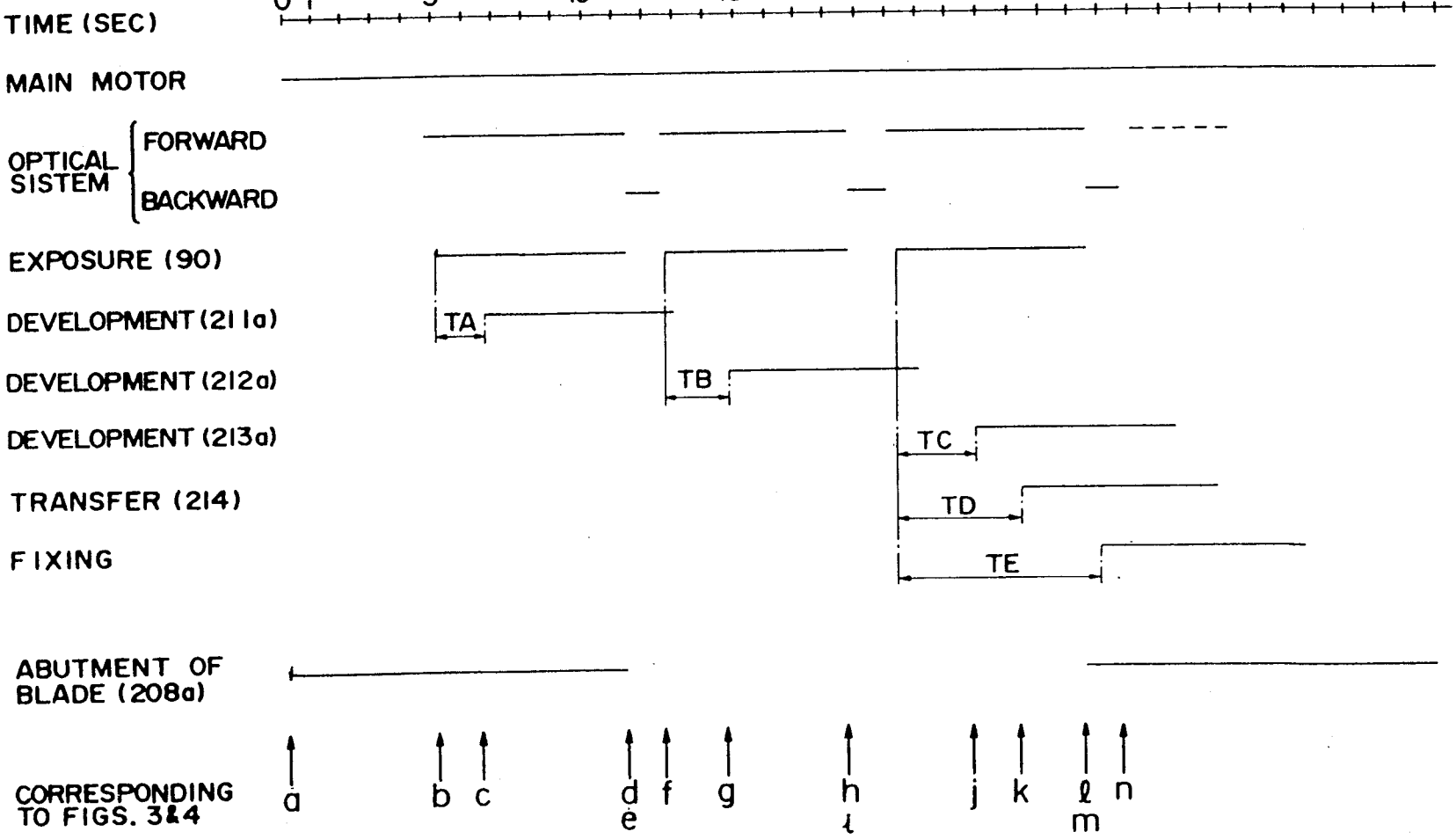
FIG. 21 is a time chart of the image forming steps of FIGS. 19 and 20.

In case the distance to each developing device is set under that condition, as shown in FIG. 2, and if the drum circumference velocity is set at 58 mm/sec, the time chart of the aforementioned image forming process is shown in FIG. 21. The time periods from the exposing point 90 to the respective developing sleeves 211*a*, 212*a* and 213*a*, the transfer electrode 214, and a fixing device (although not shown) apart by 150 mm from said transfer electrode 214 are expressed by the following equations, respectively:

$$TA = \pi \cdot 140\ \text{mm}/58\ \text{mm} \times 83^\circ/360^\circ = 1.75\ \text{(secs);}$$

$$TB = \pi \cdot 140\ \text{mm}/58\ \text{mm} \times (83^\circ + 25^\circ)/360^\circ = 2.27;$$

-continued $$TC = \pi \cdot 140\ \text{mm}/58\ \text{mm} \times (83^\circ + 25^\circ + 25^\circ)/360^\circ = 2.80;$$

$$TD = \pi \cdot 140\ \text{mm}/58\ \text{mm} \times (83^\circ + 25^\circ + 25^\circ + 62^\circ)/360^\circ = 4.11;\ \text{and}$$

$$TE = TD + 150\ \text{mm}/58\ \text{mm} = 6.69.$$

As has been described hereinbefore, according to the present invention, the image forming apparatus having the aforementioned structure on the basis of the present invention is freed from any fear of the misregistrations of the individual colors so that it can form a color image of high quality and can be efficiently coupled for use.

According to the present invention, moreover, since the operation of bringing the cleaning device such as the blade member into or out of abutment is not started during the exposure of the original image or during the writing of the latent image, there can be provided a color image forming apparatus, in which the images corresponding to the individual colors can be exposed all over the image surface under the condition of the respectively constant turning velocities of the photosensitive drum so that a transferred color image of high quality can be formed with neither distorsion nor disturbance.

What is claimed is:

1. A method of cleaning an image retainer by removing remaining toner particles from said retainer after transferring a multi-color toner image which is obtained by a multi-color toner image forming process wherein charging, image writing-in, and developing steps are repeated at least twice, said method comprising abutting a cleaning member against said retainer after a final image writing-in step of said image forming process has been completed, and releasing said cleaning member from said abutment after said cleaning has been completed but not during an image writing-in step for forming a next multi-color toner image wherein, an initial image writing-in step for a next multi-color toner image is started after said abutting and completed before said releasing and a second image writing-in step for said next multi-color toner image is started after said releasing.

2. The method of claim 1 wherein said abutting is started after said developing step for developing a final latent image formed after a final image writing-in step has been completed.

3. The method of claim 1 wherein said image retainer comprises a photoconductive material.

4. The method of claim 3 wherein a second image writing-in step is carried out in the presence of a first toner image.

5. The method of claim 1 wherein an image exposure light of said image writing-in step is a dot light.

6. The method of claim 6 further comprising controlling a supplemental cleaning member by interconnection with said cleaning member.

7. A method of forming a multi-color toner image comprising, in sequence, the steps of;

forming a first color toner image on an image retainer by a multi-color toner image forming process wherein charging, image writing-in and developing steps are repeated at least twice during plural rotations of the image retainer, transferring said first color toner image formed on said image retainer to a transfer material, removing toner particles remaining on said image retainer after transferring, forming a second color toner image on said image retainer by said multi-color toner image forming process; and transferring said second color toner image formed on said image retainer to the transfer material, wherein the plural image formation and transferring steps are carried out during continuous rotations of said image retainer said method further comprising abutting a cleaning member against said image retainer for the toner particle removing step after a final image writing-in step of said image forming process has been completed, and releasing said cleaning member from said abutment after said cleaning has been completed, wherein abutting is not carried out during the image writing-in step in said second color toner image forming step and an initial image writing-in step in said second color toner image forming step is carried out after said releasing of the abutment.

8. The method of claim 7 wherein said abutment is carried out after a final developing step in said first color toner image forming step.

9. The method of claim 7 wherein a first charging step in said second color toner image forming step is carried out after said releasing.

10. The method of claim 7 wherein said image retainer comprises a photoconductive material.

11. The method of claim 10 wherein a second image writing-in step is carried out in the presence of a first toner image.

12. The method of claim 7 wherein an image exposure light of said image writing-in step is a dot light.

13. The method of claim 7 further comprising controlling a supplemental cleaning member by interconnection with said cleaning member.

* * * * *